United States Patent [19]

Kimura et al.

[11] Patent Number: 4,551,422

[45] Date of Patent: Nov. 5, 1985

[54] SILVER HALIDE PHOTOGRAPHIC LIGHT-SENSITIVE MATERIAL

[75] Inventors: Toshihiko Kimura, Hachioji; Yutaka Kaneko, Sagamihara; Takashi Sasaki, Hino, all of Japan

[73] Assignee: Konishiroku Photo Industry Co., Ltd., Tokyo, Japan

[21] Appl. No.: 684,981

[22] Filed: Dec. 21, 1984

Related U.S. Application Data

[63] Continuation-in-part of Ser. No. 572,767, Jan. 23, 1984, abandoned.

[30] Foreign Application Priority Data

Jan. 29, 1983 [JP] Japan ..... 58-13140

[51] Int. Cl.[4] ..... G03C 7/26

[52] U.S. Cl. ..... 430/551; 430/546; 430/552; 430/553

[58] Field of Search ..... 430/546, 551, 552, 553

[56] References Cited

U.S. PATENT DOCUMENTS

| | | | |
|---|---|---|---|
| 2,835,579 | 5/1958 | Thirtle et al. | 430/546 |
| 3,698,909 | 10/1972 | Lestina et al. | 430/551 |
| 3,700,455 | 10/1972 | Ishikawa et al. | 430/551 |
| 4,427,767 | 1/1984 | Aoki et al. | 430/553 |
| 4,450,228 | 5/1984 | Shimba et al. | 430/553 |
| 4,489,155 | 12/1984 | Sakanoue et al. | 430/551 |

*Primary Examiner*—J. Travis Brown

*Attorney, Agent, or Firm*—Frishauf, Holtz, Goodman & Woodward

[57] ABSTRACT

A silver halide photographic light-sensitive material comprising a support bearing thereon at least one silver halide emulsion layer, in which at least one of phenol cyan couplers having Formula (I) below and at least one of non-color-developable and diffusion resistive phenol compounds are contained.

Formula (I)

wherein, $R_1$ represents a ballast radical necessary for endowing a phenol cyan coupler having Formula (I) and a cyan dye to be formed by the above-mentioned coupler with diffusion resistance; Ar represents an aryl radical; and X represents a hydrogen atom or a radical capable of splitting off through a coupling to an oxidant of an aromatic primary amine color developing agent.

15 Claims, No Drawings

SILVER HALIDE PHOTOGRAPHIC LIGHT-SENSITIVE MATERIAL

This application is a continuation-in-part, of application Ser. No. 572,767, filed Jan. 23, 1984, now abandoned.

DETAILED DESCRIPTION OF THE INVENTION

1. Background of the Invention Technical Field of the Invention

The invention relates to a silver halide photographic light-sensitive material, and more particularly to a silver halide color photographic light-sensitive material suitable for negative use.

2. Description of the Prior Art and the Problems Thereof

Ordinarily, a color image is obtained by color dyes prepared by the interaction of the oxidants of an aromatic primary amine color developing agent and couplers. Subtractive color process is ordinarily applied to multicolor photographic elements in order to form color images, and the dyes produced by coupling process are normally cyan, magenta or yellow dyes produced in or adjacent to a silver halide emulsion layer of which sensitivity is within the wavelength range of light to be absorbed by image forming dyes, that is, a silver halide emulsion of which sensitivity is in a red, green or blue spectral range.

Characteristics of couplers required for producing each of these dyes include, for example, sharp hue of color developing dyes produced by such couplers, excellent color reproductivity, excellent light resistance, and the like.

As cyan couplers capable of satisfying these characteristics, a phenol and a naphthol have been popularly used. In particular, with such naphthol couplers, the absorption maximums (hereinafter called λmaxs) of the produced color developing dyes are of long waves, the auxiliary absorption thereof are less in green spectral range, and the color reproductivity thereof are excellent, therefore, the naphthol couplers have been practically applied to high-speed color negative light-sensitive materials.

However, in either case of the naphthol couplers or the phenol couplers, there has been such a serious defect as that those color developing dyes have been, for the most part, discolored when having come into contact with ferrous ions. That is to say, in an ordinary color developing process, an excess of reduced ferrous ions are produced in a bleaching step or in a bleach-fix step, and cyan dyes produced in the color developing process are discolored upon being reduced, therefore, a defect occurs in that the development stability is deteriorated.

Especially in recent years, there have been trends toward the lowering of replenishment rate of developing liquid and the increase in silver amount of a color light-sensitive material with the purpose of improving the sensitivity or the image quality thereof. These trends have led to the increase in such ferrous ion density in a bleaching step. Accordingly, countermeasures against such reduction discoloration of cyan dyes are confronted with more severe requirements. It is, therefore, the inevitable course to demand cyan couplers which are hardly discolored.

Well-known couplers not causing any reduction discoloration of cyan dyes in a bleaching step or a bleach-fix step are phenol cyan couplers in which the second and fifth positions of phenol are substituted respectively by acylamino radicals, such as described, for example, in U.S. Pat. No. 2,895,826, and Japanese Patent Publication Open to Public Inspection (hereinafter called Japanese Patent O.P.I. Publication) Nos. 112,038/1975, 109/630/1978 and 163,537/1980, and the like. In these cyan couplers, the λmax of the color developing dyes are in the shorter wavelength range than the red spectral range, and the absorption increases in green spectral range. These cyan couplers are therefore not desired from the viewpoint of color reproduction.

Phenol cyan couplers having ureido radical in the second position thereof are described, for example, in British Pat. No. 1,011,940, and U.S. Pat. Nos. 3,446,622, 3,996,253, 3,758,308 and 3,880,661. Also, in these phenol cyan couplers as are similar to the aforementioned cyan couplers, there are problems that the λmax of the color developing dyes are in the shorter wavelength range than the red spectral range, the absorption is broad that is not desirable from the viewpoint of color reproduction, and some of such couplers are discolored in a bleach step.

On the other hand, as for the couplers in which cyan dyes thereof have been improved so as not to discolor in a bleaching step, but to provide the λmax of the cyan dyes into a relatively longer wavelength range, there have been well-known phenol cyan couplers such as described, for example, in Japanese Patent O.P.I. Publication No. 65,134/1981, in which a specific ureido radical is introduced into the second position of phenol of the coupler. However, the λmax thereof is in a shorter wavelength range than those of the aforementioned naphthol cyan couplers, and they are not fully satisfactory to use.

In the ureido type phenol cyan couplers such as described, for example, in Japanese Patent O.P.I. Publication Nos. 204,543/1982, 204,544/1982 and 204,545/1982; Japanese Patent Application Nos. 131,312/1981, 131,313/1981 and 131,314/1981, the cyan dyes thereof are not discolored in a bleaching step, and the λmax are in a relatively longer wavelength range. Inter alia, the phenol cyan couplers, relating to the invention, having the Formula [I] below, are preferable, because the λmax thereof are in a long wavelength range which is equal to those of naphthol cyan couplers.

However, in a cyan dye produced by the ureido type phenol cyan coupler, it was found that the λmax in the portion of high color-density is in a considerably longer red spectral wavelength range, however, the λmax in the portion of low color-density is shifted to a short wavelength side. In particular, it became apparent that the phenol cyan couplers, relating to the invention, having Formula [I] below, are remarkable in shifting to the short wavelength side.

When the λmax is thus varied, the hue becomes more bluish in a low density portion than in a high density portion. This kind of phenomena will disturb a correct color reproduction, and it is needless to say that this is not preferable. Accordingly, there has been demanded a silver halide color photographic light-sensitive material in which the λmax thereof is not varied, a satisfactory wavelength range is even in a low density portion and no discoloration is caused.

OBJECTS OF THE INVENTION

It is an object of the invention to provide a silver halide photographic light-sensitive material in which the λmax of a cyan dye image to be formed is satisfactory in a relatively longer wavelength side of the red spectral range and the auxiliary absorption is relatively less in the green spectral range.

Another object of the invention is to provide a silver halide photographic light-sensitive material in which the variations of the hue thereof are relatively less caused by the color density variation of a cyan dye image to be formed.

A further object of the invention is to provide a silver halide photographic light-sensitive material in which a reduction discoloration of a cyan dye image to be formed is substantially less caused by ferrous ions in a bleaching step.

The above-mentioned objects of the invention may be accomplished by a silver halide photographic light-sensitive material comprising a support bearing thereon at least one silver halide emulsion layer, in which at least one of phenol cyan couplers having Formula [I] below and at least one of non-color-developable and diffusion resistive phenol compounds are contained.

Formula [I]

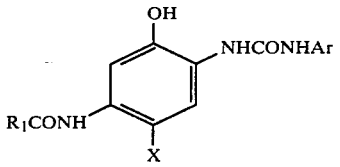

Wherein, $R_1$ represents a ballast radical necessary for endowing a phenol cyan coupler having Formula [I] and a cyan dye to be formed by the above-mentioned coupler with diffusion resistance; Ar represents an aryl radical; and X represents a hydrogen atom or a radical capable of splitting off through a coupling to an oxidant of an aromatic primary amine color developing agent.

DESCRIPTION OF THE INVENTION

To accomplish the objects of the invention in a silver halide photographic light-sensitive material relating to the invention, it is required that the light-sensitive material contain a phenol cyan coupler relating to the invention and having Formula [I], and a non-color-developable and diffusion resistive phenol compound relating to the invention in one and the same silver halide emulsion layer.

It has so far been well known that a phenol cyan coupler and a phenol compound are contained in combination into one and the same silver halide emulsion layer, the descriptions thereof are appeared, for example, in Japanese Patent O.P.I. Publication Nos. 151,149/1975, 48,535/1979, 26,133/1973, 9,449/1976, 132,925/1975, 10,430/1978 and the like. The phenol compounds described in the above literatures have been used as the so-called anti-oxidant, however, they cannot accomplish the objects of the invention such as the λmax of a cyan dye image is to be in a long wavelength range, though they are effective on the prevention of a cyan dye image discoloration caused by oxidation or on the prevention of stains caused in a background area. U.S. Pat. Nos. 2,835,579 and 4,124,396 and British Pat. Nos. 1,001,947 and 1,076,054 describe respectively that a phenol compound is used for a high-boiling organic solvent. Those inventions cannot, however, accomplish the objects of this invention. U.S. Pat. No. 4,178,183 also discloses that a specific naphthol cyan coupler and a specific high-boiling solvent are combined to produce microcrystal to the cyan dye of the coupler so that the λmax of a photographic element may be in a long wavelength portion extending over to an infrared spectral range. However, that invention does not fully satisfy every object of this invention, and does not forecast at all that the objects of this invention may be accomplished by a combination of a phenol cyan coupler relating to this invention having Formula [I] and a non-color-developable and diffusion resistive phenol compound relating to this invention.

In this invention, a ballast radical represented by $R_1$ in Formula [I], which is necessary for endowing a phenol cyan coupler with a diffusion resistance, (hereinafter simply called a ballast radical), is preferably a straight or branch chained alkyl radical having four to 30 carbon atoms such as a t-butyl radical, an n-octyl radical, a t-octyl radical, an n-dodecyl radical, an n-octyloxyethyl radical, an n-dodecyloxymethyl radical, a benzyl radical, or the like; an alkenyl radical such as an n-dodecenyl radical, an n-octadecenyl radical, a phenylpropenyl radical, or the like; an aryl radical such as a phenyl radical, a tolyl radical, or the like; a cycloalkyl radical such as a cyclohexyl radical, or the like; a five- or six-membered heterocyclic radical; or the like.

The more preferable ballast radicals have the Formula [II] below:

Formula [II]

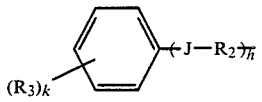

Wherein, $R_3$ represents a halogen, an alkyl radical, an aryl radical, a heterocyclic radical, an alkoxy radical, an aryloxy radical, a hydroxy radical, an acyloxy radical, a carboxy radical, an alkoxycarbonyl radical, an aryloxycarbonyl radical, a mercapto radical, an alkylthio radical, an arylthio radical, an acyl radical, an acylamino radical, a sulfonamide radical, a carbamoyl radical, a sulfamoyl radical, a nitro radical, a cyano radical, or the like, and $R_3$ may be either of the same and the different provided that k represents an integer of not less than two; $R_2$ represents a straight- or a branched-chained alkylene radical of which an aryl radical is substituted; J represents an oxygen, a sulphur or a sulfonyl radical; h is an integer of zero or one; k is an integer from zero to four and preferably from zero to two.

In Formula [II], a halogen atom represented by $R_3$ is preferably chlorine, or bromine; the alkyl radical is preferably a straight- or branch-chained one having one to 20 carbon atoms, and more preferably a methyl radical, a t-butyl radical, a t-pentyl radical, an n-octyl radical, an n-dodecyl radical, an n-pentadecyl radical or the like; the aryl radical is preferably a phenyl group; and the heterocyclic radical is preferably a nitrogen-containing one. The alkoxy radical represented by $R_3$ is preferably a straight- or branch-chained alkoxy radical having one to 20 carbon atoms, and more preferably, a methoxy radical, an ethoxy radical, a t-butyloxy radical, an n-octyloxy radical, an n-decyloxy radical, or n n-dodecyloxy radical; the aryloxy radical is preferably a phenoxy radical; the acyloxy radical is preferably an alkylcarbonyloxy radical, or n arylcarbonyloxy radical and, more preferably, an acetoxy radical or a benzoyloxy radical; the alkoxycarbonyl radical is preferably a straight- or branch-chained alkoxycarbonyl radical having one to 20 carbon atoms; and the aryloxycarbonyl radical is preferably a phenoxycarbonyl radical. Further, the alkylthio radical represented by $R_1$ is preferably a straight- or branch-chained one having one to 20 carbon atoms; the acyl radical is preferably a straight- or branch-chained alkylcarbonyl radical having one to 20 carbon atoms; the acylamino radical is preferably a straight- or branch-chained alkylcarbamide radical having one to 20 carbon atoms or a benzenecarbamide radical; the sulfonamido radical is preferably a straight- or branch-chained alkylsulfonamide radical having one to 20 carbon atoms or a benzenesulfonamide radical; the carbamoyl radical is preferably a straight- or branch-chained alkylaminocarbonyl radical having one to 20 carbon atoms or a phenylaminocarbonyl radical; the sulfamoyl radical is preferably a straight or branch-chained alkylaminosulfonyl radical having one to 20 carbon atoms or a phenylaminosulfonyl radical; and these radicals each may have respective substituents. These substituents include, for example, an alkyl radical having one to 10 carbon atoms such as an ethyl radical, an i-propyl radical, an i-butyl radical, a t-butyl radical, a t-octyl radical or the like; an aryl radical such as a phenyl radical or a naphthyl radical; a halogen atom such as fluorine, chlorine, bromine or the like; a cyano radical; a nitro radical; a sulfonamide radical such as an alkylsulfonamide radical including a methanesulfonamide radical, a butanesulfonamide radical or the like, an arylsulfonamide radical including a p-toluenesulfonamide radical or the like; a sulfamoyl radical such as an alkylsulfamoyl radical including a methylsulfamoyl radical, an arylsulfamoyl radical, including a phenylsulfamoyl radical, or the like; a sulfonyl radical such as an alkylsulfonyl radical including methanesulfonyl radical, an arylsulfonyl radical including a p-toluenesulfonyl radical, a halogenosulfonyl radical including a fluorosulfonyl radical, or the like; a carbamoyl radical such as an alkylcarbamoyl radical including a dimethylcarbamoyl, etc., an arylcarbamoyl radical including a phenylcarbamoyl radical, or the like; an oxycarbonyl radical such as an alkoxycarbonyl radical including an ethoxycarbonyl radical, etc., an aryloxycarbonyl radical including a phenoxycarbonyl radical, etc., or the like; an acyl radical such as an alkylcarbonyl radical including an acetyl radical, etc., an arylcarbonyl radical including a benzoyl radical, etc., on the like; a heterocyclic radical such as a nitrogen-containing heterocyclic radical including a pyridyl radical, a pyrazolyl radical, etc., or the like; an alkoxy radical; an aryloxy radical; an acyloxy radical; or the like.

Among the $R_3$, the more preferable one is a straight- or branch-chained alkyl radical having one to 20 carbon atoms and the further preferable one is a branch-chained alkyl radical having three to 20 carbon atoms such as a t-butyl radical, a t-pentyl radical, a t-octyl radical or the like.

The alkylene radical represented by $R_2$ is preferably a straight- or branch-chained one having one to 20 carbon atoms and, more preferably, an alkylene radical having the formula of

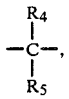

wherein $R_4$ and $R_5$ each represent hydrogen, a straight- or branch-chained alkyl radical having one to 20 carbon atoms, such as a methyl radical, an ethyl radical, an n-propyl radical, an i-propyl radical, an n-butyl radical, an i-butyl radical, a sec-butyl radical, a t-butyl radical, a t-amyl radical, an n-octyl radical, an n-dodecyl radical, an n-octadecyl radical or the like, or an aryl radical such as a phenyl radical or the like.

J is preferably oxygen.

In this invention, the aryl radical represented by Ar appeared in Formula [I] is, for example, a phenyl radical, a naphthyl radical or the like and, preferably the phenyl radical and, further preferably the phenyl radical having one or not less than two substituents. The substituents include, for example, a sulfonyl radical such as an alkylsulfonyl radical including a methylsulfonyl, ethylsulfonyl, or butylsulfonyl radical or the like, a cycloalkylsulfonyl radical including a cyclohexylsulfonyl radical or the like, an alkenylsulfonyl radical including a vinylsulfonyl radical or the like, or an arylsulfonyl radical including a phenylsulfonyl radical or the like; a sulfamoyl radical such as an alkylsulfamoyl radical including a methylsulfamoyl radical, an ethylsulfamoyl radical or the like, an arylsulfamoyl radical including a phenylsulfamoyl radical, etc., or the like; an alkyl radical such as a methyl radical, an ethyl radical or the like; an aryl radical such as a phenyl radical or the like; an alkoxy radical such as a methoxy radical, an ethoxy radical or the like; an aryloxy radical such as a phenoxy radical or the like; an acyloxy radical such as an alkylcarbonyloxy radical including an acetoxy radical, etc., an arylcarbonyloxy radical, including a benzoyloxy radical, or the like; a hydroxy radical; a nitro radical; a cyano radical; a hydroxycarbonyl radical; an alkoxycarbonyl radical such as a methoxycarbonyl radical, an ethoxycarbonyl radical, etc.; an aryloxycarbonyl radical such as a phenoxycarbonyl radical or the like; an alkylthio radical such as a methylthio radical, an ethylthio radical or the like; an arylthio radical such as a phenylthio radical or the like; an acyl radical such as an alkylcarbonyl radical including a methylcarbonyl radical, an ethylcarbonyl radical, etc., an arylcarbonyl radical including a benzoyl radical, etc.; an acylamino radical such as an alkylcarbonylamino radical including an acetylamino radical, etc., an arylcarbonylamino radical including a benzoylamino radical, etc.; a sulfonamide radical such as an alkylsulfonamide radical including a methylsulfonamide radical, etc., an arylsulfonamide radical including a benzenesulfonamide radical, etc.; a carbonamide radical such as an alkylcarbonamide radical including a methylcarbonamide radical, etc., an arylcarbonamide radical including a benzenecarbonamide radical, etc.; a carbamoyl radical such as an alkylcarbamoyl radical including a methylcarbamoyl radical, etc., an arylcarbamoyl radical including a phenylcarbamoyl radical; a sulfamoyl radical such as an alkylsulfamoyl radical including a methylsulfamoyl radical, etc., an arylsulfamoyl radical including a phenylsulfamoyl radical, etc.; a halogen such as chlorine, fluorine, bromine or the like.

The preferable Ar include a phenyl radical having one to three sulfonyl radicals, and in this case the phenyl radical may be allowed to have or not to have one or not less than two substituents mentioned above, besides the sulfonyl radicals.

The more preferable radicals represented by Ar are those having the Formula [III] below:

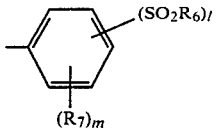

Formula [III]

Wherein, $R_6$ represents an alkyl radical and preferably a straight- or branch-chained alkyl radical having one to 20 carbon atoms such as a methyl radical, an ethyl radical, an n-propyl radical, an n-butyl radical, a t-butyl radical, an n-pentyl radical, a t-octyl radical, an n-dodecyl radical, a benzyl radical or the like; a cycloalkyl radical and preferably that having five to seven carbon atoms, such as a cyclohexyl radical or the like; an alkenyl radical and preferably that having two to 20 carbon atoms, such as a vinyl radical, an allyl radical, an oleyl radical or the like; an aryl radical and preferably a phenyl radical or a naphthyl radical; or an amino radical such as an $—NH_2$ radical or an alkylamino radical and preferably a straight- or branch-chained monoalkylamino radical having one to four carbon atoms, including a methylamino radical, an ethylamino radical, an i-propylamino radical, an n-butylamino radical or the like, or a dialkylamino radical having two to six carbon atoms in total, including a dimethylamino radical, a diethylamino radical or the like; or it is also allowed that the two alkyl radicals of the dialkylamino radical are coupled to each other to form a nitrogen-containing heterocyclic radical such as an

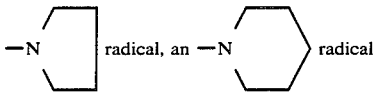

When further providing a substituent to the alkyl, cycloalkyl, alkenyl, aryl or amino radical represented by $R_6$ in itself, the substituents include, for example, an alkyl radical having one to ten carbon atoms such as an ethyl radical, an i-propyl radical, an i-butyl radical, a t-butyl radical, a t-octyl radical or the like; an aryl radical such as a phenyl radical or a naphthyl radical; a halogen such as fluorine, chlorine, bromine or the like; a cyano radical; a nitro radical; a sulfonamide radical such as an alkylsulfonamide radical including a methanesulfonamide radical or a butanesulfonamide radical, an arylsulfonamide radical including a p-toluenesulfonamide radical; a sulfamoyl radical such as an alkylsulfamoyl radical including a methylsulfamoyl radical, an arylsulfamoyl radical including a phenylsulfamoyl radical; a sulfonyl radical such as an alkylsulfonyl radical including a methanesulfonyl radical, an arylsulfonyl radical, e.g., a p-toluenesulfonyl radical, a halogenosulfonyl radical including a fluorosulfonyl radical; a carbamoyl radical such as an alkylcarbamoyl radical including a dimethylcarbamoyl radical, an arylcarbamoyl radical including a phenylcarbamoyl radical, etc.; an oxycarbonyl radical such as an alkyloxycarbonyl radical including an ethoxycarbonyl radical, etc., an aryloxycarbonyl radical including a phenoxycarbonyl radical, etc.; an acyl radical such as an alkylcarbonyl radical including an acetyl radical, an arylcarbonyl radical including a benzoyl radical, etc.; a heterocyclic radical such as a nitrogen-containing one including a pyridyl radical, a pyrazolyl radical, etc.; an alkoxy radical; an aryloxy radical; an acyloxy radical; or the like.

$R_6$ is preferably a straight- or branch-chained alkyl having one to eight carbon atoms, and in these cases they are allowed to have or not to have the above-mentioned substituents.

$R_7$ represents a monovalent radical capable of substituting a hydrogen atom of the benzene ring. Such monovalent radicals are, for example, a halogen such as chlorine or bromine; an alkyl radical and preferably a straight- or branch-chained one having one to 20 carbon atoms including, for example, a methyl radical, a t-butyl radical, a t-pentyl radical, a t-octyl radical, an n-dodecyl radical, an n-pentadecyl radical or the like; an aryl radical such as a phenyl radical; a heterocyclic radical such as a nitrogen-containing one; an alkoxy radical and preferably a straight- or branch-chained one having one to 20 carbon atoms, including, for example, a methoxy radical, an ethoxy radical, a t-butyloxy radical, an n-octyloxy radical, an n-decyloxy radical or an n-dodecyloxy radical; an aryloxy radical such as a phenoxy radical; a hydroxyl radical; an acyloxy radical and, preferably, an alkylcarbonyloxy radical including, for example, an acetoxy radical, and an arylcarbonyloxy radical including, for example a benzoyloxy radical; a hydroxycarbonyl radical; an alkoxycarbonyl radical and, preferably, a straight- or branch-chained alkyloxycarbonyl radical having one to 20 carbon atoms; an aryloxycarbonyl radical and, preferably, a phenoxycarbonyl radical; an alkylthio radical and, preferably, those each having one to 20 carbon atoms; an acyl radical and, preferably, a straight- or branch-chained alkylcarbonyl radical having one to 20 carbon atoms; an acylamino radical and, preferably, a straight- or branch-chained alkylcarbamide radical and a benzenecarbamide radical; a sulfonamide radical and, preferably, a straight- or branch-chained alkylsulfonamide radical having one to 20 carbon atoms, and a benzene sulfonamide radical; a carbamoyl radical and, preferably, a straight- or branch-chained alkylaminocarbonyl radical having one to 20 carbon atoms, and a phenylaminocarbonyl radical; a sulfamoyl radical and, preferably, a straight- or branch-chained alkylaminosulfonyl radical having one to 20 carbon atoms, and a phenylaminosulfonyl radical; a nitro radical; a cyano radical; or the like.

In the case that such a monovalent radical which is represented by $R_7$ and which is also capable of being substituted by a benzene ring has a further substituent, the substituents are, for example, an alkyl radical having one to ten carbon atoms, such as an ethyl radical, an i-propyl radical, an i-butyl radical, a t-butyl radical, a t-octyl radical or the like; an aryl radical such as a phenyl radical or a naphthyl radical; a halogen such as fluorine, chlorine, bromine or the like; a cyano radical; a nitro radical; a sulfonamide radical such as a methanesulfonamide radical, an alkylsulfonamide radical including a butanesulfonamide radical, an arylsulfonamide radical including a p-toluenesulfonamide radical and the like; a sulfamoyl radical such as an alkylsulfamoyl radical including a methylsulfamoyl radical and the like, an arylsulfamoyl radical including a phenylsulfamoyl radical and the like; a sulfonyl radical such as an alkylsulfonyl radical including a methanesulfonyl radical and the like, an arylsulfonyl radical including a p-toluenesulfonyl radical and the like, and a halogenosulfonyl radical including a fluorosulfonyl radical and the like; a carbamoyl radical such as an alkylcarbamoyl radical including a dimethylcarbamoyl radical and the like, and an arylcarbamoyl radical including a phenylcarbamoyl radical and the like; an oxycarbonyl radical such as an alkoxycarbonyl radical including an ethoxycarbonyl radical and the like, and an aryloxycarbonyl radical including a phenoxycarbonyl radical and the like; an acyl radical such as an alkylcarbonyl radical including an acetyl radical and the like, an arylcarbonyl radical including a benzoyl radical and the like; a heterocyclic radical such as a nitrogen-containing one including a pyridyl radical, a pyrazolyl radical and the like; an alkoxy radical; an aryloxy radical; an acyloxy radical; or the like.

$R_7$ is, preferably, a straight- or branch-chained alkyl radical having one to 20 carbon atoms, such as a methyl radical, an n-butyl radical, a t-butyl radical, a trifluoromethyl radical, or the like; a halogen such as chlorine, fluorine or the like; a nitro radical; or a cyano radical.

l is an integer of one to three; m is an integer of zero to three. When these l and m each are an integer of two or more, two or more $—SO_2R_6$ radicals or $—R_7$ radicals present may be the same or the different.

The radical represented by X in Formula [I], which is capable of splitting off by coupling to an oxidant of an aromatic primary amine color developing agent is, for example, a halogen such as chlorine, bromine, fluorine and the like; an aryloxy radical to which an oxygen atom or a nitrogen atom is directly coupled in the coupling position of the radical; an aryloxy radical; a carbamoyloxy radical; a carbamoylmethoxy radical; an acyloxy radical; a sulfonamide radical; a succiuimide radical; or the like. In addition, the concrete examples thereof are described, for example, in U.S. Pat. No. 3,741,563, Japanese Patent Examined Publication No. 36894/1973, and Japanese Patent O.P.I. Publication Nos. 37425/1972, 10135/1975, 117422/1975, 130441/1975, 108841/1976, 120334/1975, 18315/1977, 105226/1978, 14736/1979, 48237/1979, 32071/1980, 65957/1980, 1938/1981, 12643/1981 and 27147/1981.

The following examples disclose illustrative phenol cyan couplers having the Formula [I] and relating to the invention. However, it is to be understood that the invention is not limited thereto.

(I-1)

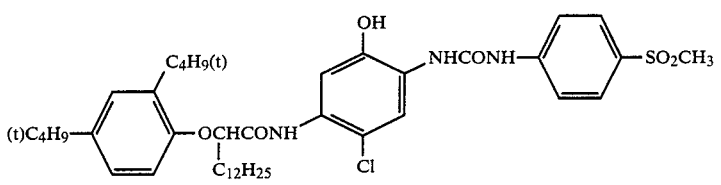

(I-2)

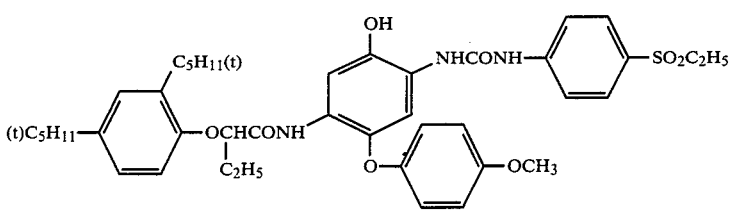

(I-3)

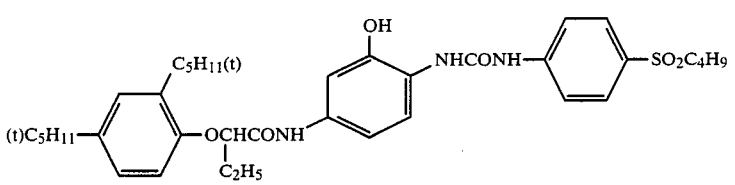

(I-4)

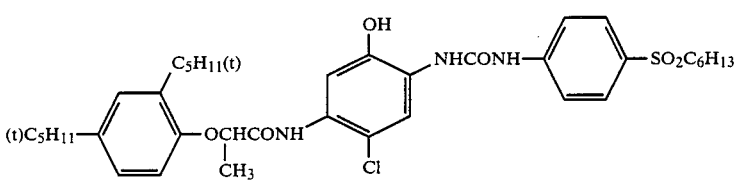

(I-5)

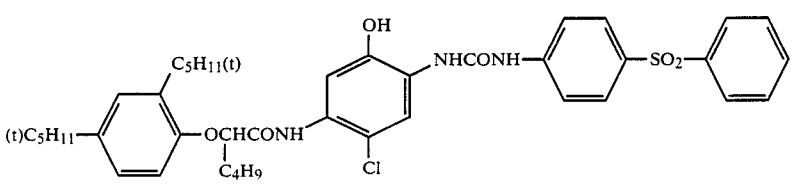

-continued
(I-6)
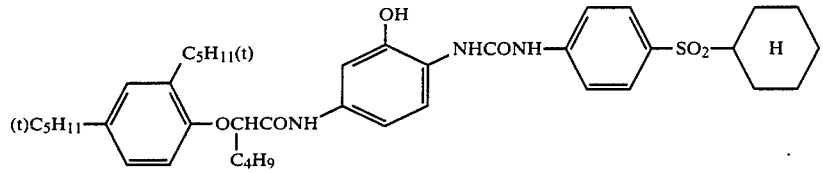
(I-7)
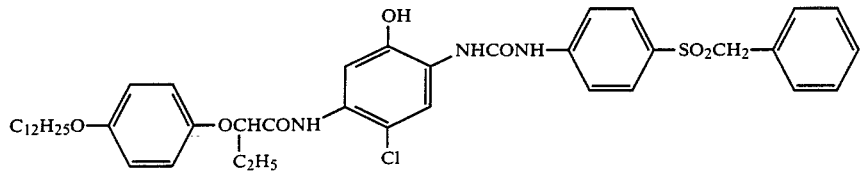
(I-8)
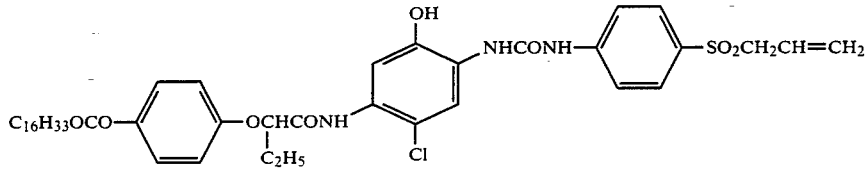
(I-9)
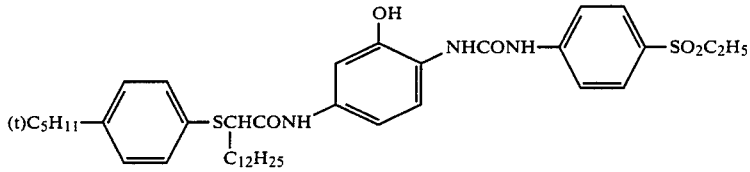
(I-10)
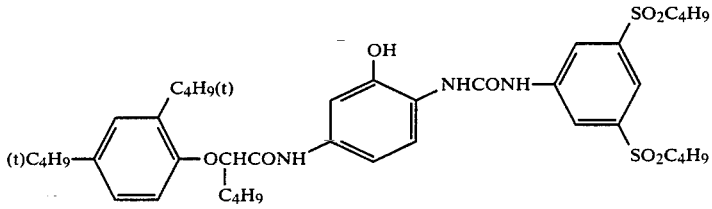
(I-11)
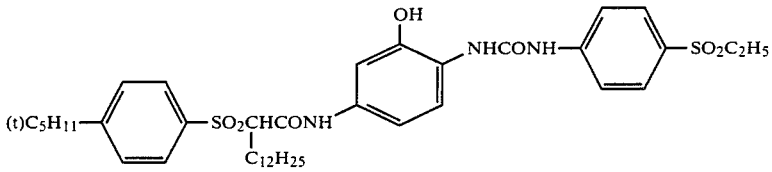
(I-12)
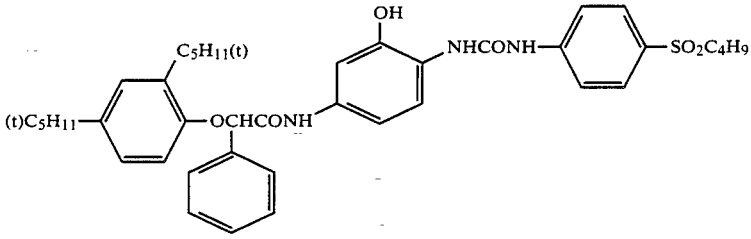
(I-13)
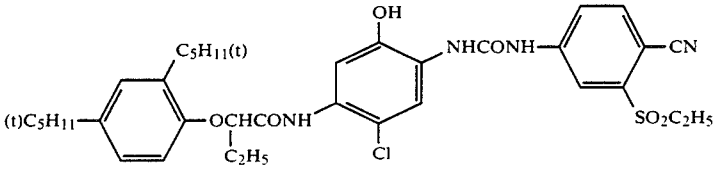

-continued
(I-14)
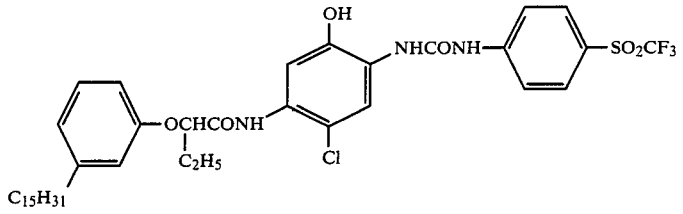
(I-15)
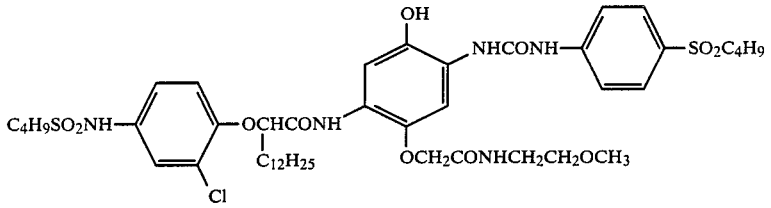
(I-16)
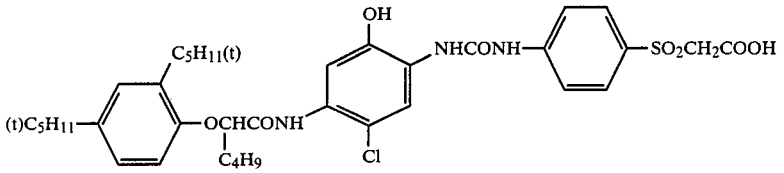
(I-17)
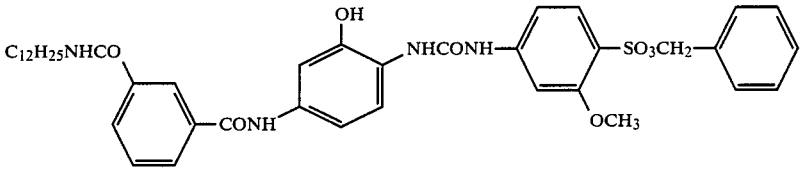
(I-18)
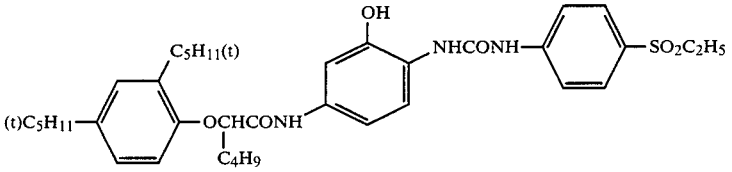
(I-19)
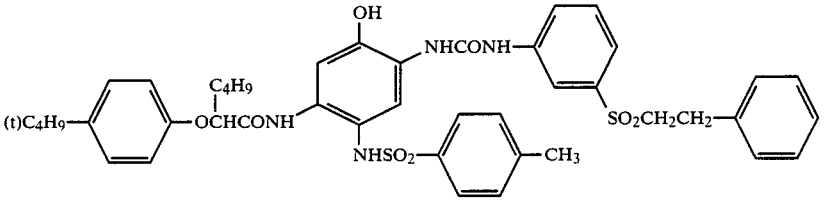
(I-20)
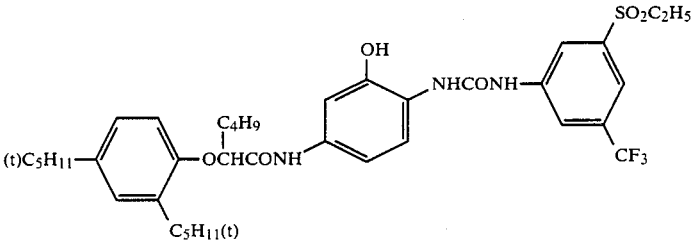

-continued
(I-21)
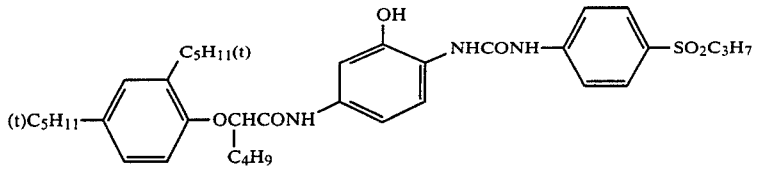
(I-22)
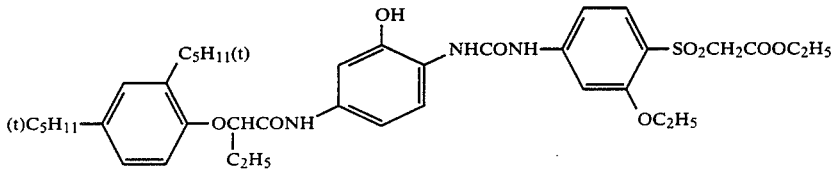
(I-23)
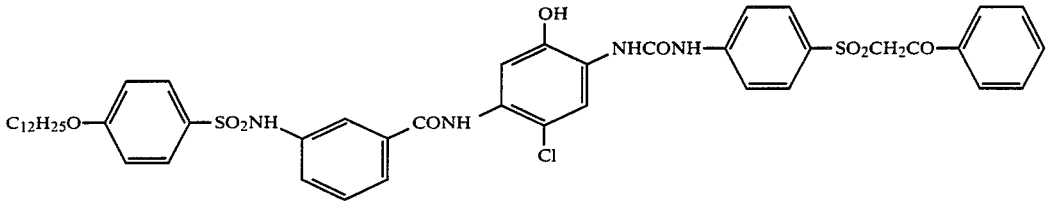
(I-24)
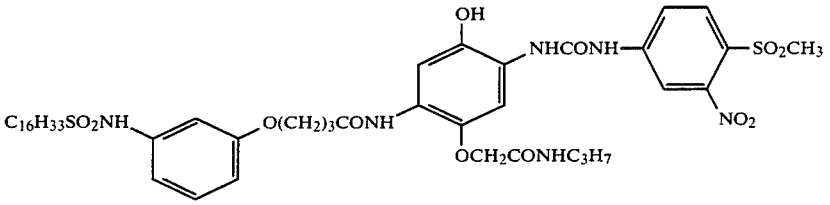
(I-25)
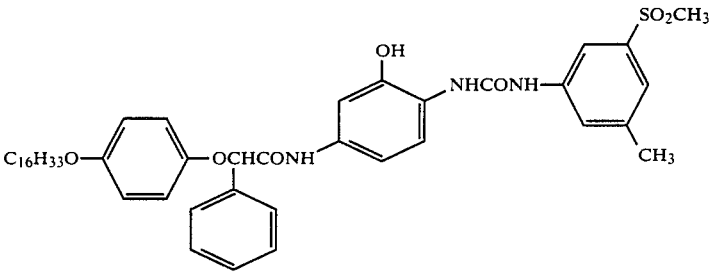
(I-26)
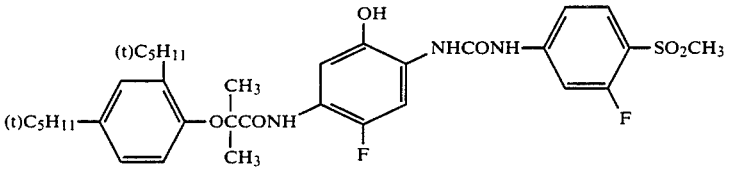
(I-27)
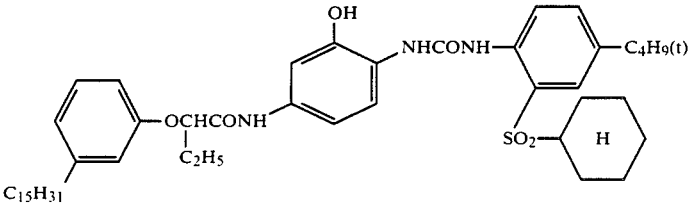

-continued
(I-28)
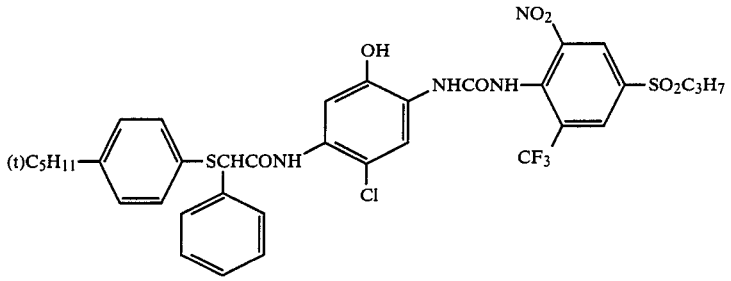
(I-29)
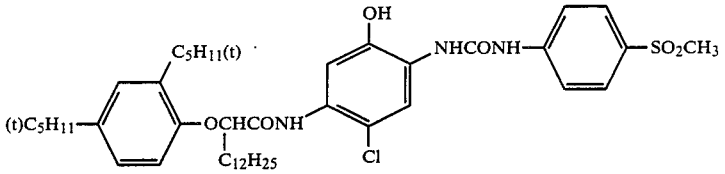
(I-30)
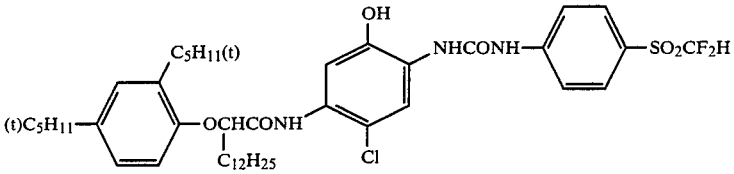
(I-31)
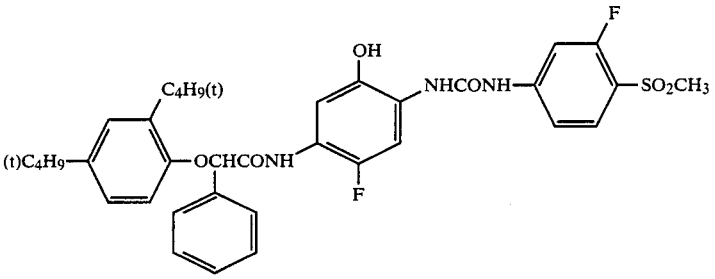
(I-32)
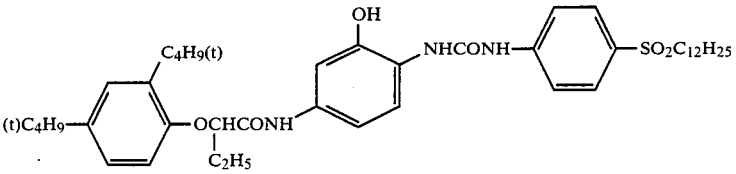
(I-33)
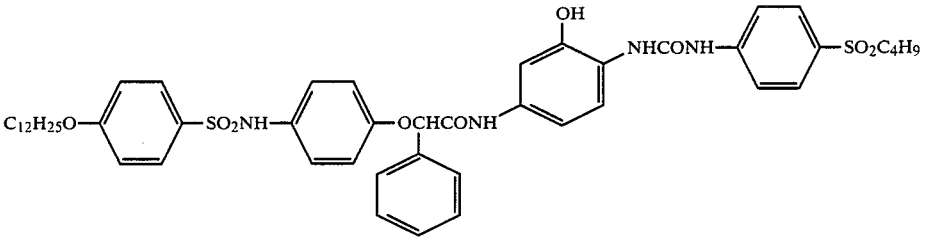
(I-34)
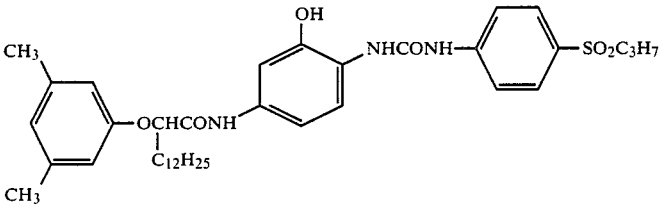

-continued
(I-35)
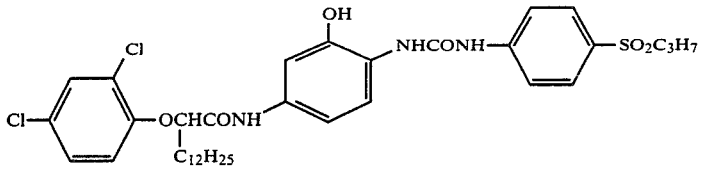
(I-36)
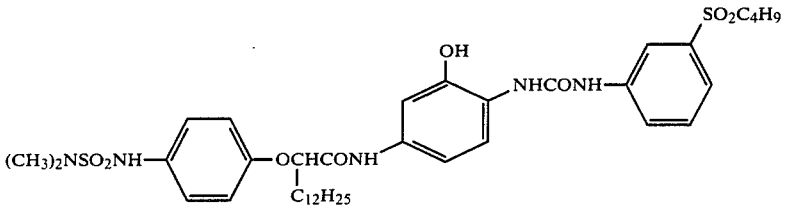
(I-37)
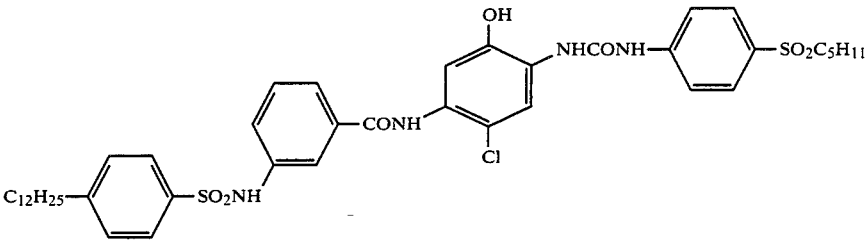
(I-38)
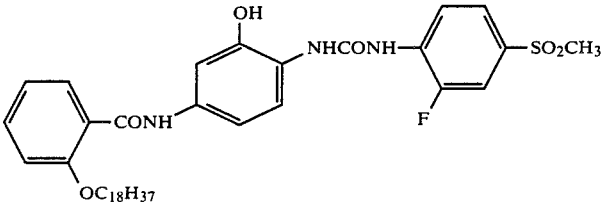
(I-39)
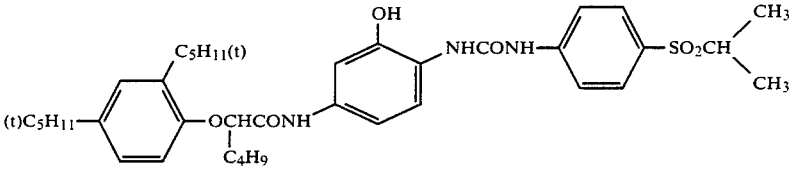
(I-40)
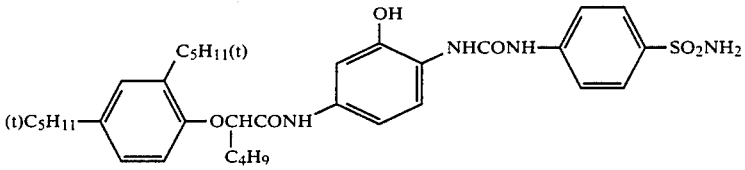
(I-41)
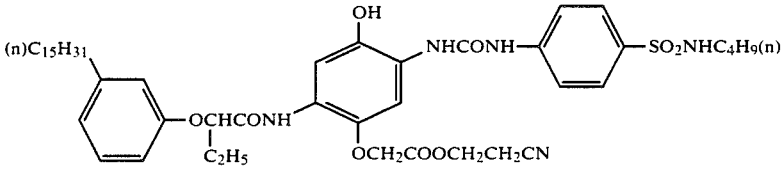

-continued
(I-42)
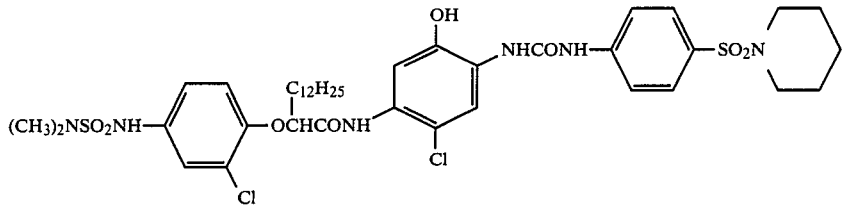
(I-43)
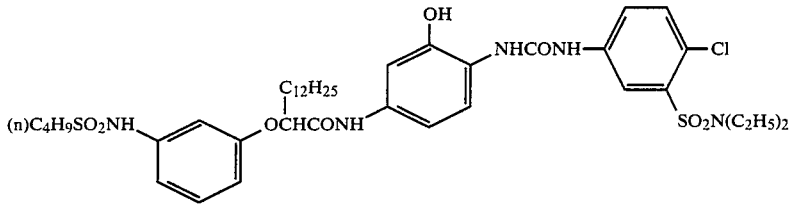
(I-44)
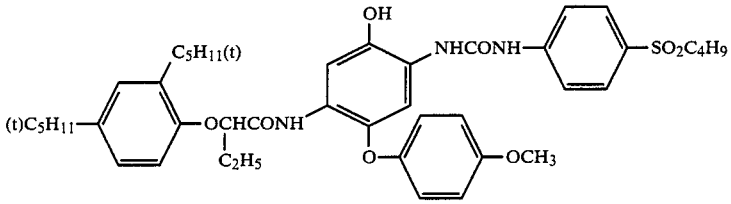
(I-45)
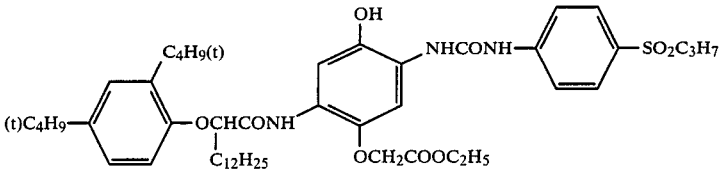
(I-46)
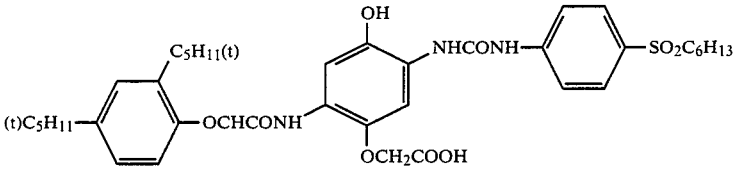
(I-47)
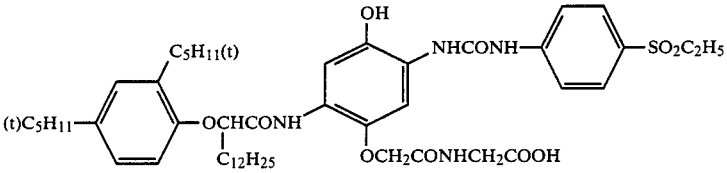
(I-48)
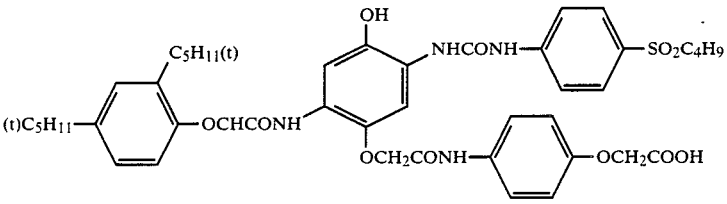

-continued (I-49)

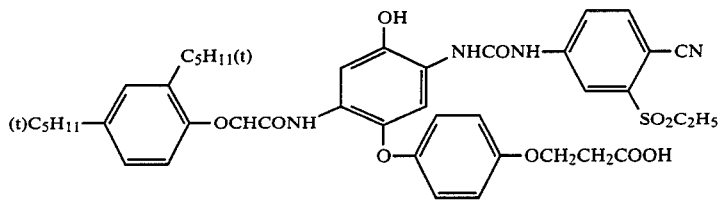

(I-50)

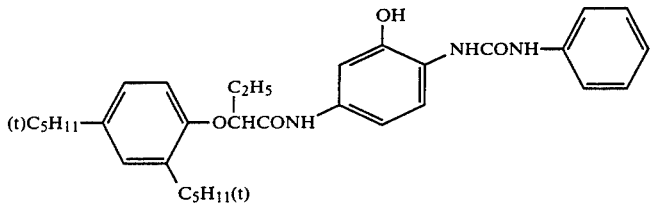

(I-51)

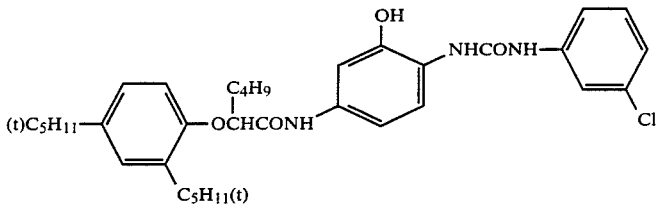

The non-color-developable and diffusion resistive phenol compounds relating to this invention are of substantially non-color-developable even though a color developing process which will be described later can be applied to a silver halide photographic light-sensitive material of this invention. To be more specific, should a silver halide photographic light-sensitive material of this invention be prepared containing phenol cyan couplers having Formula [I] and relating to this invention and non-color-developable and diffusion resistive phenol compounds relating to this invention in the same mole amount respectively in a silver halide emulsion layer of the light-sensitive material, and a color developing process of which will be described later is applied to the silver halide photographic light-sensitive material, it is then desired that the color density of the non-color-developable and diffusion resistive phenol compound relating to the invention be not higher than one fortieth (1/40) of that of the phenol cyan coupler having Formula [I] and relating to this invention.

The reasons why such a non-color-developable and diffusion resistive phenol compound relating to this invention is endowed with a diffusion resistance are that the phenol compound and the phenol cyan coupler having Formula [I] and relating to the invention are contained in one and the same silver halide emulsion layer, and also that the objects of this invention can be accomplished only when the described phenol compound is endowed with a diffusion resistance.

In other words non-color-developable and diffusion resistive phenol compounds relating to the invention will be satisfactory because as described above, that they are non-color-developable and diffusion-resistive. For example, the well-known phenol high-boiling organic solvents and the like which have been conventionally used for dispersing couplers, may be applied.

Among the described non-color-developable and diffusion-resistive phenol compounds relating to this invention, the compounds preferably usable in this invention have the melting points of not higher than 50° C. and they are solid at ordinary temperature, i.e., 25° C. or they are liquid at ordinary temperature and have the boiling points of not lower than 200° C. at atmospheric pressure. It is also preferable that the fourth position of a phenol ring is substituted by a radical which is coupled to the oxidant of an aromatic primary amine color developing agent so as not to split off.

A further preference for having such a radical is for endowing such phenol compound with a diffusion resistance.

The described non-color-developable and diffusion-resistive phenol compounds are preferably those having the Formula [IV] below:

Formula [IV]

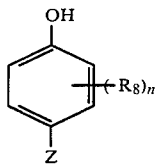

In Formula [IV], Z represents an alkyl radical such as a straight- or branch-chained one preferably having one to 20 carbon atoms including a methyl radical, an ethyl radical, a t-butyl radical, a t-pentyl radical, a t-octyl radical, an n-nonyl radical, an n-dodecyl radical and the like; an alkenyl radical preferably having two to 20 carbon atoms, including an aryl radical, an oleyl radical and the like; an aryl radical preferably including a phenyl radical, or a naphthyl radical; a cycloalkyl radical such as those preferably having five to seven carbon atoms, including a cyclohexyl radical; an alkylcarbonyl radical preferably a straight- or branch-chained one having one to 20 carbon atoms, including an acetyl radical; an arylcarbonyl radical preferably including a benzoyl radical; an alkoxycarbonyl radical such as a straight- or branch-chained alkoxycarbonyl radical preferably having one to 20 carbon atoms, including an acetoxy radical; an aryloxycarbonyl radical preferably including phenoxycarbonyl radical; or a cyano radical. When the described radical represented by Z have a substituent, such substituents are, for example, an alkyl radical having one to ten carbon atoms, such as an ethyl radical, an i-propyl radical, an i-butyl radical, t-butyl radical, t-octyl radical or the like; an aryl radical such as a phenyl radical or a naphthyl radical; a halogen such as fluorine, chlorine, bromine or the like; a cyano radical; a nitro radical; a sulfonamide radical such as an alkylsulfonamide radical including a methanesulfonamide radical, a butanesulfonamide radical and the like, an arylsulfonamide radical including a p-toluenesulfonamide radical, or the like; a sulfamoyl radical such as an alkylsulfamoyl radical including a methylsulfamoyl radical, an arylsulfamoyl radical including a phenylsulfamoyl radical, and the like; a sulfonyl radical such as an alkylsulfonyl radical including a methanesulfonyl radical, an arylsulfonyl radical including a p-toluenesulfonyl radical, a halogenosulfonyl radical including a fluorosulfonyl radical, or the like; a carbamoyl radical such as an alkylcarbamoyl radical including a dimethylcarbamoyl radical, an arylcarbamoyl radical including a phenylcarbamoyl radical, or the like; an oxycarbonyl radical such as an alkyloxycarbonyl radical including an ethoxycarbonyl radical, an aryloxycarbonyl radical including a phenoxycarbonyl radical, or the like; an acyl radical such as an alkylcarbonyl radical including an acetyl radical and the like, an arylcarbonyl radical including a benzoyl radical, or the like; a heterocyclic radical such as a nitrogen-containing one including a pyridyl radical, a pyrazolyl radical and the like; an alkoxy radical; an aryloxy radical; an acyloxy radical; and the like.

In Formula [IV], $R_8$ represents a monovalent radical substitutable for a phenol ring. Those monovalent radicals are, for example, a halogen including preferably chlorine and bromine; an alkyl radical such as a straight- or branch-chained one preferably having one to 20 carbon atoms, including a methyl radical, a t-butyl radical, a t-pentyl radical, a t-octyl radical, an n-dodecyl radical, an n-pentadecyl radical and the like; an aryl radical such as a phenyl radical; a heterocyclic radical preferably including a nitrogen-containing one; an alkoxy radical such as, preferably, a straight- or branch-chained alkoxy radical having one to 20 carbon atoms, including a methoxy radical, an ethoxy radical, a t-butyloxy radical, an n-octyloxy radical, an n-decyloxy radical, and an n-dodecyloxy radical; an aryloxy radical such as a phenoxy radical; a hydroxyl radical; an acyloxy radical such as, preferably, an alkylcarbonyloxy radical including an acetoxy radical, and an arylcarbonyloxy radical including a benzoyloxy radical; a hydroxycarbonyl radical; an alkoxycarbonyl radical such as, preferably, a straight- or branch-chained alkoxycarbonyl radical having one to 20 carbon atoms; an aryloxycarbonyl radical such as, preferably, a phenoxycarbonyl radical; an alkylthio radical such as, preferably, those having one to 20 carbon atoms; an acyl radical such as, preferably, a straight- or branch-chained alkylcarbonyl radical and an arylcarbonyl radical such as preferably a phenyl carbonyl; an acylamino radical such as, preferably, a straight- or branch-chained alkylcarbamide radical having one to 20 carbon atoms, and a benzenecarbamide radical; a sulfonamide radical such as, preferably, a straight- or branch-chained alkylsulfonamide radical having one to 20 carbon atoms, and a benzenesulfonamide radical; a carbamoyl radical such as, preferably, a straight- or branch-chained alkylaminocarbonyl radical having one to 20 carbon atoms, and a phenylaminocarbonyl radical; a sulfamoyl radical such as, preferably, a straight- or branch-chained alkylaminosulfonyl radical having one to 20 carbon atoms, and a phenylaminosulfonyl radical; a nitro radical; a cyano radical; an alkylsulfonyl radical such as preferably one having 1 to 20 carbon atoms; an alkenyl radical such as preferably one having 2 to 20 carbon atoms; a cycloalkyl radical such as preferably one having 5 to 7 carbon atoms; provided that when said phenol compound has two substituents represented by $R_8$ at both ortho positions of hydroxy group thereof at the same time, said two substituents should be unsubstituted alkyl radical respectively.

When such a monovalent radical represented by $R_8$ which is substituted for a benzene ring, has a further substituent, those substituents are, for example, an alkyl radical having one to ten carbon atoms, such as an ethyl radical, an i-propyl radical, an i-butyl radical, a t-butyl radical, a t-octyl radical or the like; an aryl radical such as a phenyl radical or a naphthyl radical; a halogen such as fluorine, chlorine, bromine or the like; a cyano radical; a nitro radical; a sulfonamide radical such as an alkylsulfonamide radical including a methanesulfonamide radical, a butanesulfonamide and the like, and an arylsulfonamide radical including a p-toluenesulfonamide radical and the like; a sulfamoyl radical such as an alkylsulfamoyl radical including a methylsulfamoyl radical and the like, and an arylsulfamoyl radical including a phenylsulfamoyl radical and the like; a sulfonyl radical such as an alkylsulfonyl radical including a methanesulfonyl radical and the like, an arylsulfonyl radical such as a p-toluenesulfonyl radical and the like, and a halogenosulfonyl radical such as a fluorosulfonyl radical and the like; a carbamoyl radical such as an alkylcarbamoyl radical including a dimethylcarbamoyl radical and the like, and an arylcarbamoyl radical; an oxycarbonyl radical such as an alkoxycarbonyl radical including an ethoxycarbonyl radical, and an aryloxycarbonyl radical including a phenoxycarbonyl radical; an acyl radical such as an alkylcarbonyl radical including an acetyl radical and the like and an arylcarbonyl radical including a benzoyl radical and the like; a heterocyclic radical such as a nitrogen-containing one including a pyridyl radical, a pyrazolyl radical and the like; an alkoxy radical; an aryloxy radical; an acyloxy radical; and the like.

In Formula [IV], Z is preferably a straight- or branch-chained alkyl radical having one to 20 carbon atoms, including those having a halogen atom as the substituent thereof; a cycloalkyl radical having five to seven carbon atoms; an alkenyl radical having two to 20 carbon atoms; an aryl radical; or a cyano radical. $R_8$ is preferably a straight- or branch-chained alkyl radical having one to 20 carbon atoms including those having a halogen atom as the substituent thereof; a cycloalkyl radical having five to seven carbon atoms; an alkenyl radical having two to 20 carbon atoms; an aryl radical, a cyano radical, a nitro radical; or a halogen atom.

It is preferred that a radical represented by Z or $R_8$ has five to 32 carbon atoms in total. The reason is that, if the total carbon atoms are not more than five, it is not sufficient to endow a phenol compound having Formula [IV] with a satisfactory diffusion resistance, but if exceeding 32 carbon atoms, it becomes difficult to stably, diffusedly incorporate the phenol compounds having Formula [IV] into a silver halide emulsion layer relating to this invention.

The total carbon atom number of the radicals represented by Z and $R_8$ is more preferably, six to 24.

n is an integer from zero to four, provided that, when n is not less than two, there are some instances where the objects of this invention may not be achieved by the so-called hindered phenol compounds from which the characteristics of a phenol hydroxyl group are disqualified by introducing into the two ortho positions of a phenol ring with a large three-dimensional radical such as a tertiary alkyl radical including a t-butyl radical, a t-pentyl radical, a trifluoromethyl radical and the like.

Non-color-developable and diffusion resistive phenol compounds relating to this invention may be composed of two or more phenols in combination, and when this is the case, Z and $R_6$ of the Formula [IV] are, for example, an o-hydroxyphenyl radical.

To further illustrate this invention, and not by way of limitation, the following examples of non-color-developable and diffusion-resistive phenol compounds relating to this invention:

(IV-1)

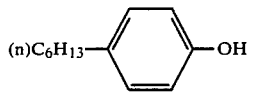

(IV-2)

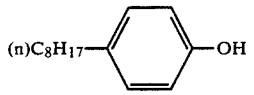

(IV-3)

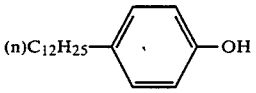

(IV-4)

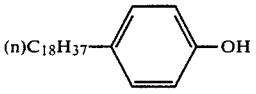

(IV-5)

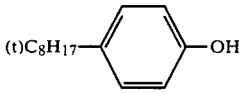

(IV-6)

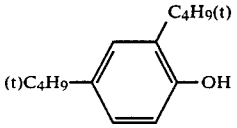

(IV-7)

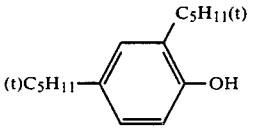

(IV-8)

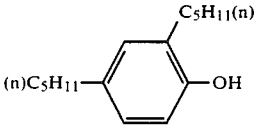

-continued (IV-9)

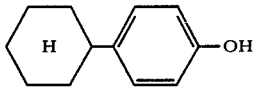

(IV-10)

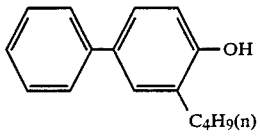

(IV-11)

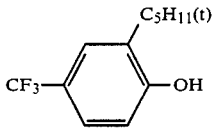

(IV-12)

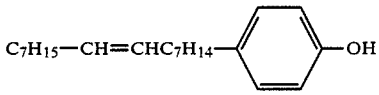

(IV-13)

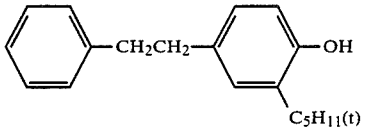

(IV-14)

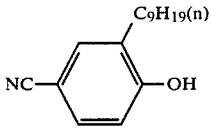

(IV-15)

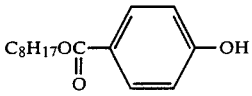

(IV-16)

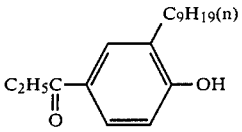

(IV-17)

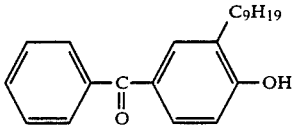

(IV-18)

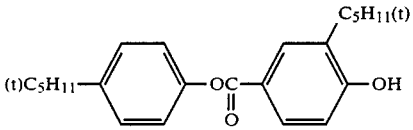

(IV-19)

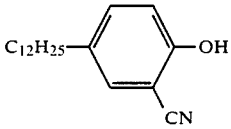

-continued (IV-20)

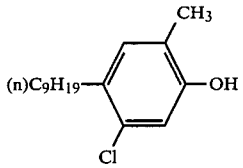

(IV-21)

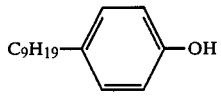

(IV-22)

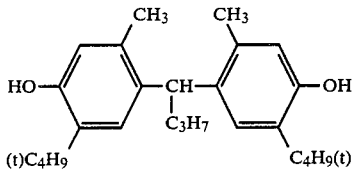

(IV-23)

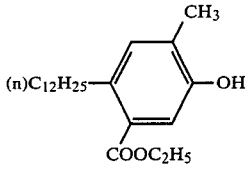

(IV-24)

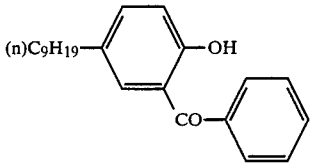

(IV-25)

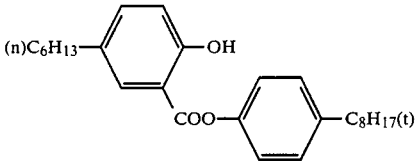

(IV-26)

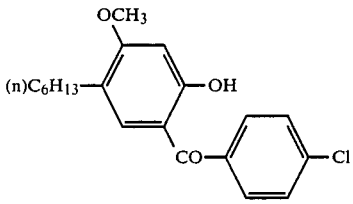

(IV-27)

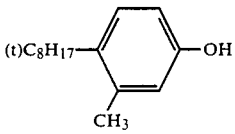

-continued (IV-28)

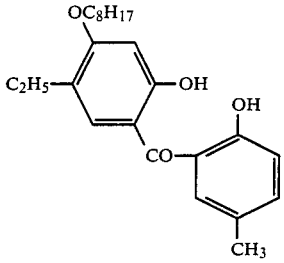

(IV-29)

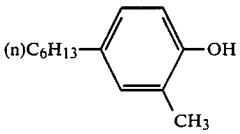

(IV-30)

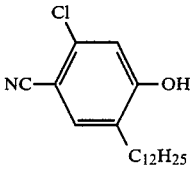

(IV-31)

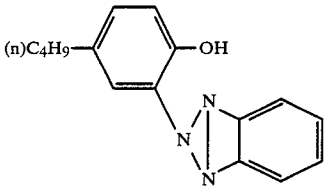

(IV-32)

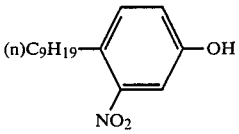

(IV-33)

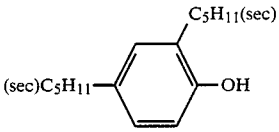

(IV-34)

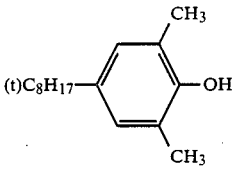

(IV-35)

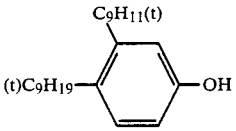

Non-color-developable and diffusion resistive phenol compounds relating to this invention may be readily synthesized in a conventional and well-known process as described, for example, in U.S. Pat. No. 2,835,579. There are also a number of the compounds on the market; and the described examples, (IV-3), (IV-5), (IV-7), (IV-21), (IV-22) and the like, are available.

When using a phenol cyan coupler relating to this invention, an ordinary cyan dye forming coupler processing method may be similarly applied thereto. In a typical process, the cyan couplers are mixed in a silver halide emulsion and the resulting emulsion is coated over to a base to form a photographic element. This photographic element may be either of a monochromatic element and a multicolor element. In a multicolor element, phenol cyan couplers relating to this invention are usually mixed in a red-sensitive emulsion, however, they may be mixed in a non-sensitized emulsion or an emulsion layer which is not sensitive to red spectral range but to the three primary color spectral range.

Each of the construction units for forming an dye image in this invention comprises a single or multi-layered emulsion layer which is sensitive to a certain spectral range.

As has been well-known by persons skilled in the art, it is possible to arrange, in various order, the layers including the described image forming unit layers, which are necessary for forming a photographic element. Typical multicolor photographic element comprises a support bearing thereon a cyan dye image forming unit comprising at least one red-sensitive silver halide emulsion layer having at least one cyan dye forming coupler in which at least one of the cyan dye forming couplers is a phenol cyan coupler relating to this invention, a magenta dye image forming unit comprising at least one green-sensitive silver halide emulsion layer having at least one magenta dye forming coupler, and a yellow dye image forming unit comprising at least one blue-sensitive silver halide emulsion layer having at least one yellow dye forming coupler.

Such photographic element may be allowed to have such an additional layer as a filter layer, an intermediate layer, a protective layer, a subbing layer, or the like.

A conventional and well-known process may be adopted to contain the phenol cyan coupler relating to this invention and the phenol compound relating thereto. For example, a silver halide emulsion layer usable for this invention is prepared in the manner that the phenol cyan coupler and the phenol compound both relating to this invention are dissolved independently or in combination in the mixture of a well-known high boiling solvent and low boiling solvent such as butyl acetate, butyl propionate or the like, and the resulting solution is mixed with an aqueous gelatin solution containing a surface active agent. Next, the resulting mixture is emulsified by a high-speed rotary mixer, a colloid mill or an ultrasonic disperser, and the resulting emulsion is added into a silver halide so that a silver halide emulsion may be prepared for using in the invention.

Well-known high boiling solvents typically include an ester phthalate such as dibutyl phthalate and the like, an ester phosphate such as tricresyl phosphate and the like, an N-substituted acid amide such as N,N-diethyl laurine amide and the like, and it is however more preferred in this invention to use the esters phthalate. Among the phenol compounds relating to this invention, some of them may also serve by themselves as a high boiling solvent, which include, for example, the exemplified compounds, (IV-1) through (IV-13), (IV-21) and the like. In this case, there is no inconvenience even if the other high boiling solvent such as an ester phthalate or the like is jointly used. The phenol compounds relating to this invention and the phenol cyan couplers relating thereto may be dispersed separately to add into one and the same silver halide emulsion; it is, however, better to dissolve them together at the same time and add them to the emulsion. In the case of adding the phenol cyan coupler relating to the invention into a silver halide emulsion, it is to be added in the amount of about 0.01 to 2 mole per mole of the silver halide and preferably 0.03 to 0.5 mole.

The effects of the invention will be greatly displayed if the phenol compounds relating to the invention are added more than the phenol cyan couplers relating to the invention, and the more the compounds are added, the greater the effects are displayed. To be more specific, the compounds are added in the amount of 0.1 to 10 g per gram of the coupler and, preferably, 0.25 to 3 g thereof.

Silver halide usable in a silver halide emulsion to be applied to the invention include arbitrary ones usable in ordinary silver halide emulsions, such as silver bromide, silver chloride, silver iodobromide, silver chlorobromide, silver chloroiodobromide and the like.

Silver halide emulsions constituting the silver halide emulsion layers relating to the invention may be prepared in every process available including processes being usually taken and various processes such as a process described in Japanese Patent Examined Publication No. 7772/1971 that is the so-called conversion emulsion preparation process in which an emulsion of silver salt particles is formed to comprise at least a part of the silver salts of which the dissolvability is greater than that of silver bromide, and at least a part of the particles is then converted into silver bromide or silver iodobromide; or Lippmann emulsion preparation process for forming Lippmann emulsion comprising fine-grain silver halide having the average diameter of not larger than 0.1$\mu$. In addition, the silver halide emulsions of this invention may be chemically sensitized by making independently or in suitable combination use of a sulphur sensitizer such as arylthiocarbamide, thiourea, cystine or the like, an active or inactive selenium sensitizer, a reduction sensitizer such as stannous salt, polyamine or the like, a noble-metal sensitizer such as a gold sensitizer concretely including potassium aurithiocyanate, potassium chloraurate, 2-aurosulfobenzothiazole methyl chloride and the like, a water-soluble salt sensitizer such as ruthenium, rhodium, iridium or the like, concretely including ammonium chloropalladate, potassium chloroplatinate, sodium chloropalladite and the like.

The silver halide emulsions usable in the invention may contain various well-known photographic additives such as those described, for example, in "Research Disclosure", No. 17643, Dec., 1978.

Such silver halide to be used in the invention is spectrally sensitized through the selection of suitable sensitizing dyes, with the purpose of endowing a red-sensitive emulsion with a photosensitivity in the photosensitive wavelength region necessary for the red-sensitive emulsion. Various kinds of the spectral sensitizing dyes may be used for this purpose, and they may be used independently or in combination of two or more kinds thereof.

As for the spectral sensitizing dyes advantageously usable in this invention, a cyanine dye, a merocyanine dye or a conjugated cyanine dye may be typically given as the examples thereof, as described, for example, in U.S. Pat. Nos. 2,269,234, 2,270,378, 2,442,710, 2,454,620 and 2,776,280.

As for the described supports relating to this invention, the conventionally known ones such as a plastic film, a plastic laminated sheet, a baryta paper, a synthetic paper and the like, may be suitably selected in accordance with the purpose of using a photographic light-sensitive material. These supports are generally sublayered to strengthen the adhesion of the support to a phtographic emulsion layer.

SUBSTANTIAL APPLICATION OF THE INVENTION

To the silver halide color photographic light-sensitive materials of the invention thus prepared, various photographic processes are selectively applied as a color-developing process, after exposing to light. The color-developing liquids to be preferably used in the invention comprise an aromatic primary amine color-developing agent as the principal component of the liquids. A p-phenylenediamine is given as a typical example of the color-developing agents. The include, for example, diethyl-p-ethylenediamine chloride, monomethyl-p-phenylenediamine chloride, dimethyl-p-phenylenediamine chloride, 2-amino-5-diethylaminotoluene chloride, 2-amino-5-(N-ethyl-N-dodecylamino)-toluene, 2-amino-5-(N-ethyl-N-β-methanesulfonamidethyl)aminotoluene sulfate, 4-(N-ethyl-N-β-methanesulfonamideethylamino)aniline, 4-(N-ethyl-N-β-hydroxyethylamino)aniline, 2-amino-5-(N-ethyl-β-methoxyethyl-)aminotoluene, and the like. These color-developing agents may be used independently or in combination of two or more kinds, and a black-and-white developing agent such as hydroquinone or the like is jointly used, if required. In addition to the above, such color-developing liquids may contain, in general, an alkali substance such as sodium hydroxide, ammonium hydroxide, sodium carbonate, sodium sulfite or the like, and it may also be allowed to contain various additives such as a halogenated alkali metal including, for example, potassium bromide, or a development regulator including, for example, hydrazinic acid and the like.

The silver halide photographic light-sensitive materials of the invention may be allowed to contain the described color-developing agent as the proper color-developing agent or as the precursor thereof, in the hydrophilic colloidal layer of the light-sensitive materials. Such precursors of the color-developing agent are the compounds capable of producing such color-developing agents under an alkaline condition, and the examples thereof are given such as a Schiff base precursor coupled to an aromatic aldehyde derivative, a polyvalent metal ion complex precursor, a phthalimide derivative precursor, a phosphoramide derivative precursor, a sugaramine reactant precursor, and an urethane precursor. These aromatic primary amine color developing agent's precursors are described, for example, in U.S. Pat. Nos. 3,342,599, 2,507,114, 2,695,234, and 3,719,492; British Pat. No. 803,783; Japanese Patent O.P.I. Publication Nos. 135,628/1978 and 79,035/1979; and "Research Disclosure", Nos. 15,159, 12,146 and 13,924.

These aromatic primary amine color developing agents or the precursors thereof must be added in a sufficient amount so as to develop a satisfactory color when developing. The amount thereof depends considerably upon the kinds of light-sensitive materials, however, the amount thereof is used roughly between 0.1 mole and five mole per mole of a light-sensitive silver halide and more preferably between 0.5 mole and three mole. These color developing agents or the precursors thereof may be used independently or in combination.

With the purpose of holding the described compounds into a photographic light-sensitive material, the compounds may also be added after dissolving in a suitable solvent such as water, methanol, ethanol, acetone or the like, or they may be added in the form of an emulsified dispersion liquid using a high boiling organic solvent such as dibutylphthalate, dioctylphthalate, tricresylphosphate or the like, and further, they may be added after impregnating them with a polymer latex, as described in Research Disclosure, No. 14850.

Silver halide color photographic light-sensitive materials of the invention are ordinarily applied with a bleach and fixing processes or a bleach-fix process and a washing process, after a color developing process. Many kinds of compounds are used as a bleaching agent and, inter alia, a polyvalent metal compound such as iron (III), cobalt (III), tin (II) or the like and, more particularly, a complex salt of the polyvalent metal cation and an organic acid, such as an aminopolycarbonate including ethylenediamine tetraacetate, nitrilotriacetate, and N-hydroxyethylenediamine diacetate, a metal complex salt including malonic acid, tartaric acid, malic acid, diglycolic acid, dithioglycolic acid or the like, a ferricyanate, a dichromate, or the like, are used independently or in suitable combination.

EFFECTS ON THE INVENTION

According to the silver halide photographic light-sensitive materials of the invention in which a cyan dye image is formed by coupling a phenol cyan coupler relating to the invention to the oxidant of an aromatic primary amine color developing agent, the λmax of the cyan dye image is made remarkably longer in wavelength and is given on a sufficiently long wavelength side of the red spectral region of the cyan dye. In addition, the auxiliary absorption is very little in the green spectral region of the cyan dye, so that not only an image excellent in color reproductivity may be obtained but the λmax is not varied even if the color density of the image is varied, and thus, the variation of the hue becomes remarkably little. Further, a cyan dye image formed is obtained as the excellent image that is remarkably less in reduction discoloration caused by ferrous ions when bleaching.

DESCRIPTION OF THE EMBODIMENTS OF THE INVENTION

The invention will be more detailedly described with reference to the following examples, and it is however to be understood that the examples given hereunder shall not be construed to limit the scope of the invention.

EXAMPLE-1

Each of the phenol cyan couplers relating to the invention shown in Table 1 was taken in the amount of 0.1 mole per mole of silver and to each of which was added by the phenol compound shown in Table 1 in the amount indicated therein and further added by a mixture solution of dibutyl phthalate in the amount of one half of the coupler amount by weight and an ethyl acetate in the amount of three times as much as the coupler amount by weight, and the resulting solution was completely dissolved upon heating up to 60° C. The solution thus resulted was mixed with 200 ml of an aqueous solution of 5% gelatin containing 20 ml of an aqueous solution of 5% Alkanol B i.e., alkylnaphthalene sulfonate, mfd. by Du Pont, and was emulsified and dispered by a colloid mill. Thus, an emulsified matter was obtained. Thereafter, the resulting dispersion solution was added to 1 kg of a red-sensitive silver iodobromide emulsion containing 6 mole % of silver iodobromide and then added by 20 ml of a 2% solution of 1,2-bis(-vinylsulfonyl)ethane in 1:1 water-methanol. The resulting solution was coated on a sublayered transparent polyester base and dried to prepare the respective samples (1-1) through (1-16) in which each amount of silver coated was $2\times10^{-4}$ ml/100 $cm^2$.

The samples thus prepared were exposed to light through a wedge in a conventional method and were then developed in the following process. The results thereof are shown in Table 1:

| Steps (at 38° C.) | Processing Time | |
|---|---|---|
| Color developing | 3*min.* | 15*sec.* |
| Bleaching | 1 | 30 |
| Washing | 3 | 15 |
| Fixing | 6 | 30 |
| Washing | 3 | 15 |
| Stabilizing | 1 | 30 |

The following were the processing liquid compositions used in the above steps:

| [Composition of Color Developing Liquid] | |
|---|---|
| 4-amino-3-methyl-N—ethyl-N—(β-hydroxyethyl)aniline sulfate | 4.75 g |
| Sodium sulfite, anhydrous | 4.25 g |
| Hydroxyamine ½ sulfate | 2.0 g |
| Potassium carbonate, anhydrous | 37.5 g |
| Sodium bromide | 1.3 g |
| Trisodium nitrilotriacetate, monohydrated | 2.5 g |
| Potassium hydroxide | 1.0 g |
| Add water to make | 1 ltr. |
| Adjust pH value by using potassium hydroxide to | pH 10.0 |

-continued

| [Composition of Bleaching Liquid] | |
|---|---|
| Iron ammonium salt ethylenediamine tetraacetic acid | 100.0 g |
| Diammonium salt ethylenediamine tetraacetic acid | 10.0 g |
| Ammonium bromide | |
| Glacial acetic acid | |
| Add water to make | 1 ltr. |
| Adjust pH value by using aqueous ammonia to | pH 6.0 |
| [Composition of Fixing Liquid] | |
| Ammonium thiosulfate (50% aqueous solution | 162 ml |
| Sodium sulfite, anhydrous | 12.4 ml |
| Add water to make | 1 ltr. |
| Adjust pH value by using acetic acid to | pH 6.5 |
| [Composition of Stabilizing Liquid] | |
| Formalin (37% acqueous solution) | 5.0 ml |
| Konidux (mfd. by Konishiroku Photo Ind. Co., Ltd., Japan) | 7.5 ml |
| Add water to make | 1 ltr. |

In Table 1, $\lambda max^{2.0}$, $\lambda max^{0.5}$ and $\Delta\lambda max$ are defined, respectively, as follow:

$\lambda max^{2.0}$: An absorption maximum wavelength(nm) in the case that a spectral density is 2.0 at the absorption maximum.

$\lambda max^{5.0}$: An absorption maximum wavelength(nm) in the case that a spectral density is 0.5 at the absorption maximum.

$\Delta\lambda max$: $\lambda max^{2.0}$-$\lambda max^{0.5}$ $\lambda max^{2.0}$ and $\lambda max^{0.5}$ are the longer, the better, $\Delta\lambda max$ represents a variation range caused by a color density variation, and the narrower the better.

In Table 1, the amount added means the amount in gram of each phenol compound added to 1 g of each cyan coupler.

In addition, the minimum density, Dmin, and the maximum density, Dmax of each cyan dye image are also shown in Table 1.

TABLE 1

| Sample No. | Cyan Couplar | Phenol Compound | Amount Added | $\lambda^{2.0}_{max}$ | $\lambda^{0.5}_{max}$ | $\Delta\lambda_{max}$ | D min | D max | |
|---|---|---|---|---|---|---|---|---|---|
| 1-1 | Exemplified Compound (1-18) | — | 0 | 696 | 683 | 13 | 0.09 | 1.90 | Blank |
| 1-2 | Exemplified Compound (1-18) | Exemplified Compound (IV-5) | 0.25 | " | 687 | 9 | " | 2.15 | This Invention |
| 1-3 | Exemplified Compound (1-18) | Exemplified Compound (IV-5) | 0.5 | 697 | 691 | 6 | 0.10 | 2.25 | This Invention |
| 1-4 | Exemplified Compound (1-18) | Exemplified Compound (IV-5) | 1.0 | 698 | 695 | 3 | 0.11 | 2.40 | This Invention |
| 1-5 | Exemplified Compound (1-18) | Exemplified Compound (IV-10) | 0.5 | 697 | 689 | 8 | 0.09 | 2.22 | This Invention |
| 1-6 | Exemplified Compound (1-18) | Exemplified Compound (IV-7) | " | 699 | 694 | 5 | " | 2.00 | This Invention |
| 1-7 | Exemplified Compound (1-18) | Exemplified Compound (IV-14) | " | 696 | 689 | 7 | " | 2.15 | This Invention |
| 1-8 | Exemplified Compound (1-18) | Exemplified Compound (IV-15) | " | 667 | " | 8 | " | 2.20 | This Invention |
| 1-9 | Exemplified Compound (1-18) | Exemplified Compound (IV-23) | " | 696 | 687 | 9 | 0.10 | 2.28 | This Invention |
| 1-10 | Exemplified Compound (1-18) | Comparative Compound [A] | 0.25 | 689 | 675 | 14 | 0.13 | 2.51 | Comparison |
| 1-11 | Exemplified | Comparative | 0.5 | 696 | 683 | 13 | 0.09 | 1.92 | Comparison |

TABLE 1-continued

| Sample No. | Cyan Couplar | Phenol Compound | Amount Added | $\lambda_{max}^{2.0}$ | $\lambda_{max}^{0.5}$ | $\Delta\lambda_{max}$ | D min | D max | |
|---|---|---|---|---|---|---|---|---|---|
| | Compound (1-18) | Compound [B] | | | | | | | |
| 1-12 | Exemplified Compound (1-18) | Comparative Compound [C] | " | " | " | " | " | 1.98 | Comparison |
| 1-13 | Exemplified Compound (1-18) | Comparative Compound [D] | 0.25 | 693 | 680 | " | " | 1.85 | Comparison |
| 1-14 | Exemplified Compound (1-18) | Comparative Compound [E] | " | N.A. | — | — | 0.01 | 0.09 | Comparison |
| 1-15 | Exemplified Compound (1-18) | Comparative Compound [F] | 0.5 | 696 | 683 | 13 | 0.09 | 1.91 | Comparison |
| 1-16 | Exemplified Compound (1-18) | Comparative Compound [G] | " | 675 | 681 | 14 | 0.07 | 1.95 | Comparison |

*No dibutyl phthalate was added to Sample (1-6).
*N.A: Cannot be measured

Comparative Compound [A]

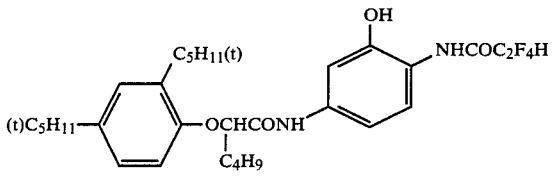

Comparative Compound [B]

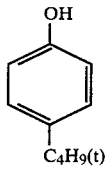

Comparative Compound [C]

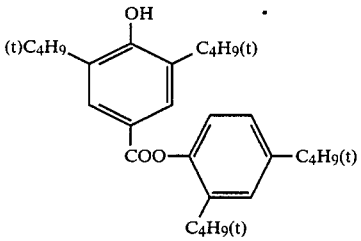

Comparative [D]

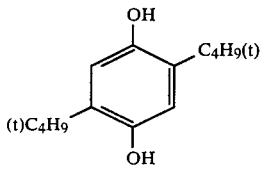

Comparative Compound [E]

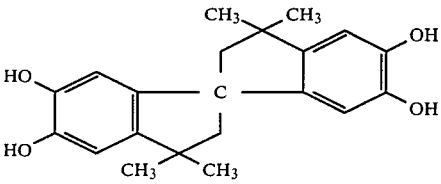

$C_{16}H_{33}OH$

Comparative Compound [F]

-continued

Comparative Compound [G]

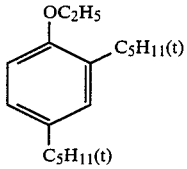

It is found from the results shown in Table 1 that, when an ureido type phenol coupler relating to the invention was independently used, the λmax was varied according to the density variations and it was in a short wavelength region; and that when a phenol compound relating to the invention was used in combination therewith, the λmax was amazingly in a long wavelength region and, in particular, the low density region, i.e., $\lambda max^{0.5}$, was in a long wavelength region, and the variation range of the λmax was therefore narrowed. It is also found that the more the amount of phenol compounds is added, the greater the effect may be.

On the other hand, the comparative compound [A], that is out of the invention, is a phenol cyan coupler in which a color is developed when a color development process is applied thereto as in this example, and the λmax thereof is is a short wavelength region such as 668 nm. Therefore, this compound [A] may not be used in the invention.

The comparative compound [B] is a phenol compound used jointly with a phenol cyan coupler so as to prevent a stain as described in Japanese Patent O.P.I. Publication No. 9449/1976. This compound is not diffusion-resistive and is fluxed from a color light-sensitive material when a color development is applied as in the invention, therefore, any effect may not be enjoyed.

The comparative compound [C] is a kind of the so-called hindered phenol compounds disqualified for the property of a phenol hydroxide radical by introducing tert-butyl radicals to the two ortho positions of the compound. Although this has been well-known as an oxidation inhibitor used in combination with a phenol cyan coupler as described in Japanese Patent O.P.I. Publication No. 48535/1979, it is found that this has not any effect at all on the objects and the effects of the invention.

The comparative compounds [D], [E] and [F] are the compounds each having a hydroxy radical, which are out of the invention, and it is found that these have no effect at all or that no dye image can be obtained because of inhibiting a color development.

The comparative compound [G] has a similar structure to that of the phenyl compound (IV-7) relating to the invention, and in which the hydroxy radical thereof is substituted by an alkoxy radical. This has also no effect at all.

As is obvious from the invention, the phenol compounds relating to the invention are inevitable to attain the objects of the invention, and they are excellent in the color developability, i.e., Dmax, Dmin.

EXAMPLE-2

Similar to EXAMPLE-1, each of the combinations of couplers and phenol compounds as shown in Table 2 below was dispersed and coated to prepare the respective samples (2-1) through (2-19).

Table 2 shows the results obtained by the development similar to that in EXAMPLE-1, and in which $\lambda max^{2.0}$, $\lambda max^{0.5}$, $\Delta\lambda max$ and amount added are synonymous with those in Table 1.

TABLE 2

| Sample No. | Cyan Coupler | Phenol Compound | Amount Added | $\lambda^{2.0}_{max}$ | $\lambda^{0.5}_{max}$ | $\Delta\lambda_{max}$ | |
|---|---|---|---|---|---|---|---|
| 2-1 | Exemplified Compound (I-5) | — | — | 694 | 677 | 17 | Blank |
| 2-2 | Exemplified Compound (I-5) | Exemplified Compound (IV-3) | 0.5 | 695 | 687 | 8 | This invention |
| 2-3 | Exemplified Compound (I-5) | Exemplified Compound (IV-22) | 1.0 | 694 | 686 | 8 | This invention |
| 2-4 | Exemplified Compound (I-11) | — | — | 700 | 678 | 22 | Blank |
| 2-5 | Exemplified Compound (I-11) | Exemplified Compound (IV-5) | 0.5 | 701 | 691 | 10 | This invention |
| 2-6 | Exemplified Compound (I-11) | Exemplified Compound (IV-11) | 0.4 | " | 693 | 8 | This invention |
| 2-7 | Exemplified Compound (I-33) | — | — | 689 | 678 | 11 | Blank |
| 2-8 | Exemplified Compound (I-33) | Exemplified Compound (IV-12) | 0.5 | 692 | 685 | 7 | This invention |
| 2-9 | Exemplified Compound (I-33) | Exemplified Compound (IV-25) | 1.0 | 691 | " | 6 | This invention |
| 2-10 | Exemplified Compound (I-40) | — | — | 687 | 673 | 14 | Blank |
| 2-11 | Exemplified Compound (I-40) | Exemplified Compound (IV-21) | 0.5 | 690 | 683 | 7 | This invention |
| 2-12 | Exemplified Compound (I-26) | — | — | 685 | 673 | 12 | Blank |
| 2-13 | Exemplified Compound (I-26) | Exemplified Compound (IV-18) | 0.5 | 688 | 681 | 7 | This invention |
| 2-14 | Comparative Coupler [G] | — | — | 662 | 666 | −4 | Comparison |
| 2-15 | Comparative Coupler [G] | Exemplified Compound (IV-10) | 0.5 | 664 | 669 | −5 | Comparison |
| 2-16 | Comparative Coupler [H] | — | — | 650 | 653 | −3 | Comparison |
| 2-17 | Comparative Coupler [H] | Exemplified Compound (IV-7) | 0.5 | 653 | 657 | −4 | Comparison |
| 2-18 | Comparative Coupler [I] | — | — | 696 | 700 | −4 | Comparison |
| 2-19 | Comparative Coupler [I] | Exemplified Compound (IV-10) | 0.5 | 698 | 702 | −4 | Comparison |

Comparative Coupler [G]

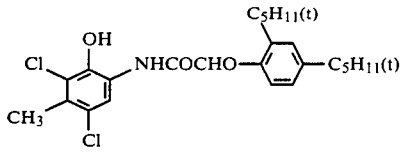

Comparative Coupler [H]

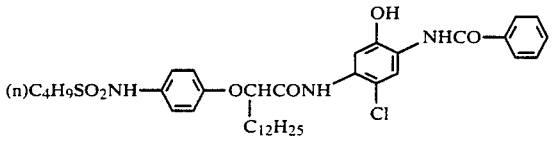

Comparative Coupler [I]

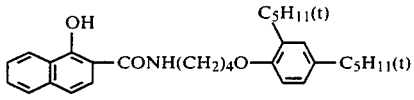

It is found from the results shown in Table 2 that, when using independently a phenol cyan coupler relating to the invention, the variations of the λmax become great and the λmax is in a short wavelength range in a low density region, and when using this coupler in combination with a phenol compound relating to the invention, the described unfavourable behavior is remarkably reduced.

Meanwhile, the color developing dyes comprising the comparative couplers [G] and [H] are of the very short wavelength regardless of adding or not adding a phenol compound, and the objects of the invention cannot be thereby attained.

The comparative coupler [I] is a preferable coupler because the λmax is in a long wavelength region and Δλmax is also little. However, as is apparent from the following EXAMPLE-3, the reduction discoloration of the color developing dye is seriously poor, and this cannot satisfy the objects of the invention. It is accordingly understood that a combination use of a phenol cyan coupler relating to the invention and a phenol compound relating to the invention is necessary for attaining the objects of the invention.

EXAMPLE-3

Two groups each of Samples (2-1) through (2-19) were exposed to light as in EXAMPLE-1. One group of them was applied by an ordinary developing process as in EXAMPLE-1, and the other group was developed as in EXAMPLE-1 except that the composition of the bleaching liquid used in EXAMPLE-1 was replaced by the following composition to investigate the reduction discoloration in the cyan dye. The results thereof are shown in Table 3.

| [Composition of Bleaching Liquid] | |
|---|---|
| Iron ammonium salt ethylenediamine tetraacetic acid | 100 g |
| Diammonium salt ethylenediamine tetraacetic acid | 10 g |
| Ammonium bromide | 150 g |
| Hydrosulfite | 5 g |
| Glacial acetic acid | 10 ml |
| Add water to make | 1 ltr. |
| Adjust pH value by using $10NH_2SO_4$ to pH 5.5 | |

In the table, the percentage of residual dyes is defined as follows;

Percentage of residual dyes=(The maximum density when using the above bleaching liquid/the maximum density when using the bleaching liquid of EXAMPLE-1)×100 wherein, the greater the percentage is, the fewer the reduction discoloration is.

TABLE 3

| Sample No. | Residual Dye Percentage (%) |
|---|---|
| 2-1 | 98 |
| 2-2 | 99 |
| 2-3 | 97 |
| 2-4 | 95 |
| 2-5 | 96 |
| 2-6 | 97 |
| 2-7 | 92 |
| 2-8 | 95 |
| 2-9 | 97 |
| 2-10 | 92 |
| 2-11 | 95 |
| 2-12 | 93 |
| 2-13 | 97 |
| 2-14 | 68 |
| 2-15 | 69 |
| 2-16 | 98 |
| 2-17 | 100 |
| 2-18 | 65 |
| 2-19 | 66 |

Taking into consideration by all accounts of both of the results shown in Tables 2, 3, it is understandable that a combination use of a phenol cyan coupler and a phenol compound both relating to the invention is effective for materializing a silver halide color photographic light-sensitive material in which the hue of a cyan dye produced that is an object of the invention is in a long wavelength region, and the hue thereof lowers a color image density variation degree, and a reduction discoloration can be remarkably reduced. Any other combination than those of the invention cannot attain the objects of the invention because of a reduction discoloration or an improper hue in itself.

EXAMPLE-4

Onto a support comprising a transparent polyethylene terephthalate film was coated in order therefrom with the following layers and, inter alia, the layers 3 and 4 which are the red-sensitive layers contain a cyan coupler and a phenol compound both relating to the invention shown in Table 4, and thus, the multi-layered color negative light-sensitive materials i.e., Samples (4-1), (4-2), were prepared.

Layer 1: Antihalation layer

An aqueous solution of gelatin containing black colloidal silver was coated in the ratio of 0.5 g of silver per sq. meter so as to be at a dry thickness of 30μ.

Layer 2: Interlayer

An aqueous solution of gelatin was coated so as to be at a dry thickness of 1.0μ.

Layer 3: Red-sensitive low-speed silver halide emulsion layer

A chemical sensitization was applied by a gold and sulphur sensitizer to a silver iodobromide emulsion prepared by mixing a silver iodobromide emulsion containing 4 mole % of silver iodide having an average particle size of 0.6μ and a silver iodobromide emulsion containing 4 mole % of silver iodide having an average particle size of 0.3μ, and to which was then added with red-sensitive sensitizing dyes, i.e., 9-ethyl-3,3'-di-(3-sulfopropyl)-4,5,4',5',-dibenzothiacarbocyanine hydroxide anhydrated; 5,5'-dichloro-9-ethyl-3,3'-di-(3-sulfobutyl)-thiacarbocyanine hydroxide anhydrated; and 2-[2-{(5-chloro-3-ethyl-2(3H)-benzothiazolidene)methyl}-1-]-butynyl-5-chloro-3-(4-sulfobutyl)benzoxazolium, and to which was further added with 1.0 g of 4-hydroxy-6-methyl-1,3,3a,7-tetrazaindene and 20.0 mg of 1-phenyl-5-mercaptotetrazole, and thus, a red-sensitive low-speed emulsion was prepared.

Next, the cyan coupler shown in Table 4 of 0.15 mole per mole of silver halide; a DIR compound, i.e., 1.7 g of 2-(1-phenyl-5-tetrazolylthio)-4-octadecyl succinimide-1-indanone; a colored cyan coupler, i.e., 0.01 mole of 1-hydroxy-4-[4-(1-hydroxy-8-acetamide-3,6-disulfo-2-naphthylazo)phenoxy]-N-[8-(2,4-di-t-amylphenoxy)-butyl]-2-naphthamide di-sodium salt; and 0.5 g of dodecyl gallate; were mixed. To the resulting mixture was further added with the phenol compound shown in Table 4, a high-boiling solvent, i.e., 50 g of dibutyl phthalate, and 150 ml of ethyl acetate. The resulting mixture was dissolved upon heating and was then added into 550 ml of an aqueous solution of 7.5% gelatin containing 5 g of sodium triisopropylnaphthalene sulfonate, and the resulting solution was dispersed upon being emulsified by a colloid mill. After heating the dispersed matter and removing the ethyl acetate, the aforementioned red-sensitive low-speed emulsion was added thereto, and the coating was made at a dry thickness of 4.0μ, so as to contain 160 g of gelatin per mole of silver halide.

Layer 4: Red-sensitive high-speed silver halide emulsion layer

A chemical sensitization was applied by a gold and sulphur sensitizer to a silver iodobromide emulsion having the average particle size of 1.2μ and containing 7 mole % of silver iodide, and to which was added by red-sensitive sensitizing dyes, i.e., 9-ethyl-3,3'-di-(3-sulfopropyl)-4,5,4',5'-dibenzothiacarbocyanine hydroxide, anhydrated; 3,3'-dichloro-9-ethyl-3,3'-di-(3-sulfobutyl)-thiacarbocyanine hydroxide, anhydrated; and 2-[2-{(5-chloro-3-ethyl-2(3H)-benzothiazolidene)methyl}-1]-butenyl-5-chloro-3-(4-sulfobutyl)benzoxazolium, and to which was further added with 1.0 g of 4-hydroxy-6-methyl-1,3,3a,7-tetrazaindene and 10.0 mg of 1-phenyl-5-mercaptotetrazole, and thus, a red-sensitive high-speed emulsion was prepared.

Further, the cyan coupler shown in Table 4 in the amount of 0.05 mole per mole of silver halide, a DIR compound, i.e., 1.6 g of 2-(1-phenyl-5-tetrazolylthio)-4-octadecylsuccinimide-1-indanone, and 0.5 g of dodecyl gallate were mixed, and to which was added with the phenol compound shown in Table 5, a high-boiling solvent i.e., 20 g of dibutyl phthalate, and 60 ml of ethyl acetate, and the resulting mixture was dissolved upon heating. The resulting solution was added to 30 ml of 7.5% gelatin solution containing 1.5 g of sodium triisopropylnaphthalene sulfonate, and the resulting solution was dispersed upon being emulsified by a colloid mill to prepare a dispersed matter, and to which was added with the aforedescribed red-sensitive high-speed emulsion. Then, a coating was made at a dry thickness of 2.0μ so as to contain 160 g of gelatin per mole of silver halide.

Layer 5: Interlayer

The same as Layer 2.

Layer 6: Green-sensitive low-speed silver halide emulsion layer

A silver iodobromide emulsion having the average particle size of 0.6μ and containing 4 mole % of silver iodide, and a silver iodobromide emulsion having the average particle size of 0.3μ and containing 7 mole % of silver iodide were chemically sensitized respectively by a gold and sulphur sensitizer, and to each of which was added with green-sensitive sensitizing dyes, i.e., 5,5'-dichloro-9-ethyl-3,3'-di-(3-sulfobutyl)oxacarbocyanine hydroxide, anhydrated; 3,3'-diphenyl-9-ethyl-3,3'-di-(3-sulfobutyl)oxacarbocyanine hydroxide, anhydrated; and 9-ethyl-3,3'-di-(3-sulfopropyl)-5,6,5',6'-dibenzoxacarbocyanine hydroxide, anhydrated. Next, 1.0 g of 4-hydroxy-6-methyl-1,3,3a,7-tetrazaindene and 20.0 mg of 1-phenyl-5-mercaptotetrazole were added to prepare the two kinds of silver halide emulsions in an ordinary process. These two emulsions were mixed together at 1:1 to prepare the green-sensitive low-speed silver halide emulsion.

Further, a magenta coupler, i.e., 1-(2,4,6-trichlorophenyl)-3-{3-(4-dodecyloxyphenyl)sulfonamide benzamide}-pyrazoline-5-on, in the amount of 100 g per mole of silver halide, a DIR compound, i.e., 1.6 g of 2-(1-phenyl-5-tetrazolylthio)-4-octadecylsuccinimide-1-indanone, a colored magenta coupler, i.e., 2.5 g of 1-(2,4,6-trichlorophenyl)-4-(1-naphthylazo)-3-(2-chloro-5-octadecenylsuccinimide anilino)-5-pyrazolone, and 0.5 g of dodecyl gallate, were mixed, and to which was added with 60 g of tricresylphosphate, 60 g of dibutyl phthalate and 240 ml of ethyl acetate. The resulting mixture was dissolved upon heating to add into an aqueous gelatin solution containing sodium triisoprophylnaphthalene sulfonate. The resulting solution was dispersed upon being emulsified by a colloid mill to produce a dispersed matter. The aforementioned green-sensitive low-speed silver halide emulsion was added with the resulting dispersed matter. Then, a coating was made at a dry thickness of 4.0μ so as to contain 160 g of gelatin per mole of silver halide.

Layer 7: Green-sensitive high-speed silver halide emulsion layer

A silver iodobromide emulsion having the average particle size of 1.2μ and containing 7 mole % of silver iodide was chemically sensitized by a gold and sulphur sensitizer, and to which was added with a green-sensitive sensitizing dye, i.e., 5,5'-dichloro-9-ethyl-3,3'-di-(3-sulfobutyl)oxacarbocyanine hydroxide, anhydrated; 5,5'-diphenyl-9-ethyl-3,3'-di(3-sulfobutyl)oxacarbocyanine hydroxide, anhydrated; and 9-ethyl-3,3'-di-(3'sulfopropyl)-5,6,5',6'-dibenzoxacarbocyanine hydroxide, anhydrated. Next, to this was further added with 1.0 g of 4-hydroxy-6-methyl-1,3,3a,7-tetrazaindene and 10.0 mg of 1-phenyl-5-mercaptotetrazole, and thus, a green-sensitive high-speed silver halide emulsion was prepared.

Further, to this emulsion was added with a magenta coupler, i.e., 80 g of 1-(2,4,6-trichlorophenyl)-3-{3-(2,4-di-t-amylphenoxyacetamide}-pyrazoline-5-on, a colored magenta coupler, i.e., 2.5 g of 1-(2,4,6-trichlorophenyl)-4-(1-naphthylazo)-3-(2-chloro-5-octadecenylsuccinimide anilino)-5-pyrazolone, and 1.5 g of 2,5-di-t-octylhydroquinone. To this was further mixed with 60 g of tricresylphosphate, 60 g of dibutylphthalate and 240 ml of ethyl acetate. The resulting mixture was dissolved upon heating and was then added into an aqueous gelatin solution containing sodium triisopropylnaphthalene sulfonate. The resulting solution was dispersed upon being emulsified by a colloid mill to prepare a dispersed matter. This dispersed matter was added into the aforeprepared emulsion to produce a green-sensitive high-speed emulsion. A coating was made at a dry thickness of 2.0μ so as to contain 160 g of gelatin per mole of silver halide.

Layer 8: Interlayer

The same as Layer 2.

Layer 9: Yellow-filter layer

Three grams of 2,3-di-t-octylhydroquinone and 1.5 g of di-2-ethylhexyphthalate were dissolved by 10 ml of ethylacetate, and the resulting solution was dispersed in an aqueous gelatin solution containing 0.3 g of sodium triisopropylnaphthalene sulfonate. The resulting dispersed solution was added into an aqueous gelatin solution in which yellow colloidal silver was dispersed. The resulting solution was coated at a dry thickness of 1.2μ in the ratio of 0.9 g/m$^2$ of gelatin and 0.10 g/m$^2$ of 2,5-di-t-octylhydroquinone.

Layer 10: Blue-sensitive low-speed silver halide emulsion layer

A silver iodobromide emulsion having the average particle size of 0.6μ and containing 6 mole % of silver iodide was chemically sensitized by a gold and sulphur sensitizer, and was added with a sensitizing dye, i.e., 5,5'-dimethoxy-3,3'-di-(3-sulfopropyl)thiacyanine hydroxide, anhydrated. Next, to this was added with 1.0 g of 4-hydroxy-6-methyl-1,3,3a,7-tetrazindene and 20.0 mg of 1-phenyl-5-mercaptotetrazole, to prepare a blue-sensitive low-speed silver halide emulsion in an ordinary process.

Further, to this emulsion was added with yellow couplers, i.e., α-pivaloyl-α-(1-benzyl-2-phenyl-3,5-dioxo-1,2,4-triazolidine-4-yl)-2'-chloro-5'-[α-(dodecyloxycarbonyl)ethoxycarbonyl]acetamilide of 120 g per mole of silver halide and 50 g of α-{3-[α-(2,4-di-t-amylphenoxy)butylamide)}benzoyl-2'-methoxyacetanilide, and then 120 g of dibutylphthalate and 300 ml of ethylacetate were mixed thereinto. The resulting mixture was dissolved upon heating to add into an aqueous gelatin solution containing sodium triisopropylnaphthalene sulfonate, and thus a blue-sensitive low-speed silver halide emulsion was prepared. A coating was made at a dry thickness of 4.0μ so as to contain 160 g of gelatin per mole of silver halide.

Layer 11: Blue-sensitive high-speed silver halide emulsion layer

A silver iodobromide emulsion having the averge particle size of 1.2μ and containing 7 mole % of silver iodide was chemically sensitized by a gold and sulphur sensitizer, and to this emulsion was added with a sensitizing dye, i.e., 5,5'-dimethoxy-3,3'-di-(3-sulfopropyl)-thiacyanine hydroxide, anhydrated. Next, to this emulsion was further added with 1.0 g of 4-hydroxy-6-methyl-1,3,3a,7-tetrazaindene and 10.0 mg of 1-phenyl-5-mercaptotetrazole, and thus, a blue-sensitive high-speed silver halide emulsion was prepared in an ordinary process.

Further, to this emulsion was added with a yellow coupler, i.e., α-pivaloyl-α-(1-benzyl-2-phenyl-3,5-dioxo-1,2,4-triazolidine-4-yl)-2'-chloro-5'-[α-(dodecyloxycarbonyl)ethoxycarbonyl]acetanilide of 80 g per mole of silver halide, and was further mixed with 80 g of dibutylphthalate and 240 ml of ethylacetate. The resulting mixture was dissolved upon heating and was then added into an aqueous gelatin solution containing sodium triisopropylnaphthalene sulfonate to be dispersed upon being emulsified by a colloid mill. The resulting dispersed matter was added to the aforeprepared emulsion and thus, a blue-sensitive high-speed silver halide emulsion was prepared. A coating thereof was made at a dry thickness of 2.0μ so as to contain 240 g of gelatin per mole of silver halide.

Layer 12: Interlayer

A mixture was made of 2 g of di-2-ethylhexylphthalate, 2 g of 2-[3-cyano-3-(n-dodecylaminocarbonyl)allylidene]-1-ethylpyrrolidine and 2 ml of ethyl acetate. The resulting mixture was dispersed in an aqueous gelatin solution containing 0.6 g of triisopropylnaphthalene sulfonate to prepare a dispersed matter. The dispersed matter was coated in the ratio of 1.0 g/m$^2$ of gelatin and at a dry thickness of 1.0$\mu$.

Layer 13: Protective layer

An aqueous gelatin solution containing 4 g of gelatin and 0.2 g of 1,2-bisvinyl sulfonylethane each per 100 ml of the gelatin solution was coated in the ratio of 1.3 g/m$^2$ of gelatin and at a dry thickness of 1.2$\mu$.

TABLE 4

| | Sample 4-1 | Sample 4-2 |
|---|---|---|
| Layer 3 | | |
| Cyan Coupler | Exemplified Coupler I-3 | Exemplified Coupler I-21 |
| Phenol Compound | Exemplified Compound IV-5 | Exemplified Compound IV-11 |
| Amount Added* | 1.0 | 0.75 |
| Layer 4 | | |
| Cyan Coupler | Exemplified Coupler I-3 | Exemplified Coupler I-11 |
| Phenol Compound | Exemplified Compound IV-21 | Exemplified Compound IV-32 |
| Amount Added* | 0.5 | 1.0 |

*Amount in gram per gram of cyan coupler

The high-speed multilayered color negative light-sensitive materials were exposed to light through a wedge, and were then processed similar to the case of EXAMPLE-1. Resultantly, every light-sensitive material caused no reduction discoloration and was capable of obtaining images having the absorption maximum of cyan dyes in a long wavelength range and the excellent reproductivity.

EXAMPLE-5

The procedure set forth in Example 1 was repeated using Exemplified Compound 1-18 as the cyan coupler with additional comparative compounds [J] to [P]. The results are set forth in Table 5 below and are comparable with the results set forth in Table 1.

TABLE 5

| Sample No. | Cyan Coupler | Phenol Compound | Amount Added | 2.0 λmax | 0.5 λmax | Δλmax | Dmin | Dmax |
|---|---|---|---|---|---|---|---|---|
| 1-17 | Exemplified Compound (1-18) | Comparative Compound [J] | 1.0 | 696 | 683 | 13 | 0.08 | 1.90 |
| 1-18 | Exemplified Compound (1-18) | Comparative Compound [K] | " | 695 | 681 | 14 | 0.07 | 1.78 |
| 1-19 | Exemplified Compound (1-18) | Comparative Compound [L] | " | 694 | 680 | 14 | 0.09 | 1.91 |
| 1-20 | Exemplified Compound (1-18) | Comparative Compound [M] | " | 695 | 680 | 15 | 0.09 | 1.90 |
| 1-21 | Exemplified Compound (1-18) | Comparative Compound [N] | " | 696 | 685 | 11 | 0.08 | 1.79 |
| 1-22 | Exemplified Compound (1-18) | Comparative Compound [O] | " | 695 | 684 | 14 | 0.09 | 1.85 |
| 1-23 | Exemplified Compound (1-18) | Comparative Compound [P] | " | 696 | 683 | 13 | 0.08 | 1.90 |

Comparative Compound

[J]

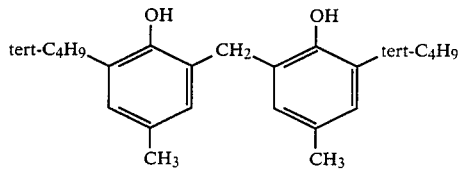

[K]

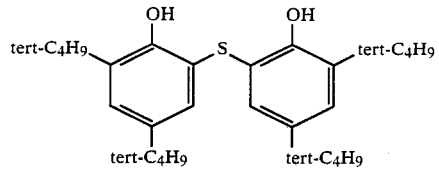

[L]

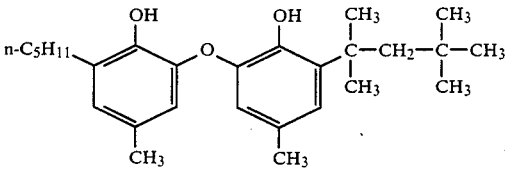

[M]

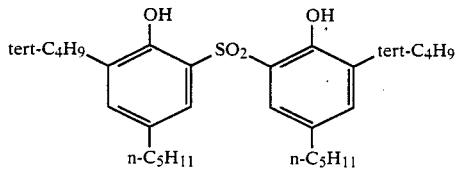

-continued

Comparative Compound

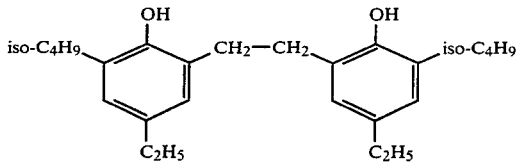

[N]

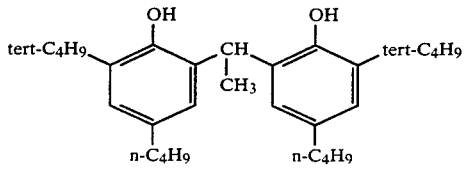

[O]

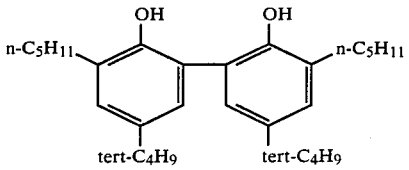

[P]

When compared with the results set forth in Table 1, for Sample Nos. 1-1 to 1-9, the use of comparative compounds [J], [K], [L], [M], [N], [O] and [P] are not shown to not narrow the λmax values.

What is claimed is:

1. A silver halide photographic light-sensitive material comprising a support bearing thereon at least one silver halide emulsion layer, said silver halide photographic light-sensitive material characterized in that said silver halide emulsion layer contains at least one phenol cyan coupler having the Formula (I)

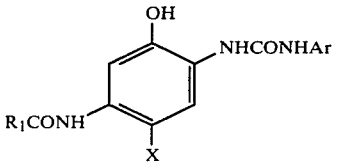

Formula (I)

wherein, $R_1$ represents a ballast radical necessary for endowing the phenol cyan coupler having Formula (I) and a cyan dye produced by the coupler with diffusion-resistance; Ar represents an aryl radical; and X represents hydrogen or a radical capable of splitting off when coupling to the oxidant of an aromatic primary amine color developing agent and at least one non-color-developable and diffusion-resistive phenol compound having the following Formula (IV):

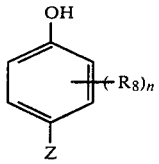

Formula IV wherein, Z represents an alkyl radical, an alkenyl radical, an aryl radical, a cycloalkyl radical, an alkylcarbonyl radical, an arylcarbonyl radical, an alkoxycarbonyl radical, an aryloxycarbonyl radical or a cyano radical; $R_8$ represents a monovalent radical capable of substituting a hydrogen atom of the phenol ring of said compound selected from the group consisting of halogen, alkyl, aryl, heterocyclic, alkoxy, aryloxy, alkylcarbonyloxy, arylcarbonyloxy, hydroxycarbonyl, alkoxycarbonyl, aryloxycarbonyl, alkylthio, alkylcarbonyl, arylcarbonyl, acylamino, sulfonamide, carbamoyl, nitro, cyano, alkysulfonyl, alkenyl and cycloalkyl radical, provided that when said phenol compound has two substituents represented by $R_8$ at the both ortho positions of hydroxy group thereof at the same time, said two substituents are unsubstituted normal or secondary alkyl radicals respectively and n is 2.

2. The silver halide photographic light-sensitive material as claimed in claim 1, wherein the ballast radical represented by $R_1$ in the Formula [I] is a straight- or branch-chained alkyl radical having four to thirty carbon atoms, an alkenyl radical, an aryl radical, a cycloalkyl radical or a five- or six-membered heterocyclic radical.

3. The silver halide photographic light-sensitive material as claimed in claim 1, wherein the ballast radical represented by $R_1$ in the Formula is a radical having the following Formula [II];

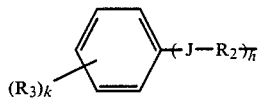

Formula [II]

Wherein, $R_3$ represents a halogen, an alkyl radical, an aryl radical, a heterocyclic radical, an alkoxy radical, an aryloxy radical, a hydroxy radical, an acyloxy radical, a carboxy radical, an alkoxycarbonyl radical, an aryloxycarbonyl radical, a mercapto radical, an alkylthio radical, an arylthio radical, an acyl radical, an acylamino radical, a sulfonamide radical, a carbamoyl radical, a sulfamoyl radical, a nitro radical, a cyano radical, and $R_3$ may be either of the same and the different provided that k represents an integer of not less than two; $R_2$ represents a straight- or a branched-chained alkylene radical of which an aryl radical is substituted; J represents an oxygen, a sulphur or a sulfonyl radical; h is an integer of zero or one; k is an integer from zero to four.

4. The silver halide photographic light-sensitive material as claimed in claim 1, wherein the aryl radical represented by Ar in the Formula [I] is a phenyl radical.

5. The silver halide photographic light-sensitive material as claimed in claim 1, wherein the aryl radical represented by Ar in the Formula [I] is a radical having the following Formula [III];

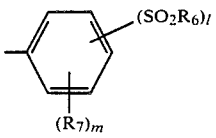

Formula [III]

Wherein, $R_6$ represents an alkyl radical, a cycloalkyl radical, an alkenyl radical, an aryl radical or an amino radical; $R_7$ represents a monovalent radical capable of substituting a hydrogen atom of the benzene ring; l is an integer of one to three; m is an integer of zero to three, and when these l and m each are an integer of two or more, two or more $—SO_2R_6$ radicals or $—R_7$ radicals present may be the same or the different.

6. The silver halide photographic light-sensitive material as claimed in claim 1, wherein the color density of the non-color-developable and diffusion-resistive phenol compound is not higher than one fortieth (1/40) of that of the phenol cyan coupler having the Formula [I], in the case that the phenol cyan coupler having the Formula [I] and the non-color-developable and diffusion-resistive phenol compound are contained in the same mole amount into a silver halide emulsion layer.

7. The silver halide photographic light-sensitive material as claimed in claim 1, wherein the non-color-developable and diffusion-resistive phenol compound has the melting point of not higher than 50° C., and is solid or liquid at ordinary temperature, and has the boiling point of not lower than 200° C. at atmospheric pressure; and the phenol ring of said compound is substituted in the fourth position thereof by a radical not splitted off by coupling to the oxidant of the aromatic primary amine color developing agent.

8. The silver halide photographic light-sensitive material as claimed in claim 1, wherein the radical represented by Z in the Formula [IV] is a straight- or branch-chained alkyl radical having one to twenty carbon atoms, a cycloalkyl radical having five to seven carbon atoms, an alkenyl radical having two to twenty carbon atoms, an aryl radical, or a cyano radical; and a radical represented by $R_8$ is a straight- or branch-chained alkyl radical having one to twenty carbon atoms, a cycloalkyl radical having five to seven carbon atoms, an alkenyl radical having two to twenty carbon atoms, an aryl radical, a cyano radical, a nitro radical, or a halogen atom.

9. The silver halide photographic light-sensitive material as claimed in claim 1, wherein the radical represented by Z and $R_8$ respectively in the Formula [IV] has five to thirty-two carbon atoms in total.

10. The silver halide photographic light-sensitive material as claimed in claim 1, wherein the phenol cyan coupler having Formula [I] and the non-color-developable and diffusion-resistive phenol compound are contained in a silver halide emulsion layer by making use of an ester phthalate.

11. The silver halide photographic light-sensitive material as claimed in claim 1, wherein the phenol cyan coupler having the Formula [I] is added in the amount 0.03 to 0.5 moles per mole of silver halide.

12. The silver halide photographic light-sensitive material as claimed in claim 1, wherein the non-color-developable and diffusion-resistive phenol compound is added in the amount of 0.25 to 3 grams per gram of the phenol cyan coupler having the Formula [I].

13. The silver halide photographic light-sensitive material as claimed in claim 1, wherein the phenol cyan coupler having the Formula [I] and the non-color-developable and diffusion-resistive phenol compound are at the same time added upon being dissolved into one and the same silver halide emulsion.

14. The silver halide photographic light-sensitive material claimed in claim 1, wherein in said non-color-developable and diffusion resistive phenol compounds $R_8$ is normal alkyl or secondary alkyl radical and n is two.

15. The silver halide photographic light-sensitive material claimed in claim 1, wherein in said non-color-developable and diffusion resistive phenol compound Z is an alkyl radical, $R_8$ is an alkyl radical and n is zero or one.

* * * * *